US006084611A

United States Patent [19]

Yamane et al.

[11] Patent Number: 6,084,611

[45] Date of Patent: Jul. 4, 2000

[54] RECORDING HEAD, HAVING PRESSURE-BONDING MEMBER FOR BINDING RECORDING ELEMENT SUBSTRATE AND DRIVING ELEMENT SUBSTRATE, HEAD CARTRIDGE AND RECORDING APPARATUS HAVING SAME

[75] Inventors: Toru Yamane, Yokohama; Toshiaki Hirosawa, Hiratsuka; Manabu Sueoka, Yokohama, all of Japan

[73] Assignee: Canon Kabushiki Kaisha, Tokyo, Japan

[21] Appl. No.: 08/728,860

[22] Filed: Oct. 10, 1996

[30] Foreign Application Priority Data

| | | | |
|---|---|---|---|
| Oct. 16, 1995 | [JP] | Japan | 7-267262 |
| Jan. 5, 1996 | [JP] | Japan | 8-000231 |
| Jan. 9, 1996 | [JP] | Japan | 8-001396 |

[51] Int. Cl.[7] ..... B41J 2/14

[52] U.S. Cl. ..... 347/50; 347/54

[58] Field of Search ..... 347/50, 42, 70, 347/1, 57, 58, 49

[56] References Cited

U.S. PATENT DOCUMENTS

| | | | |
|---|---|---|---|
| 5,091,737 | 2/1992 | Toganoh et al. | 347/42 |
| 5,164,747 | 11/1992 | Osada et al. | 346/140 R |
| 5,243,363 | 9/1993 | Koizumi et al. | 346/140 R |
| 5,485,185 | 1/1996 | Sueoka et al. | 347/64 |

FOREIGN PATENT DOCUMENTS

| | | |
|---|---|---|
| 0594110 | 4/1994 | European Pat. Off. . |
| 1-302829 | 6/1989 | Japan . |
| 2-22064 | 1/1990 | Japan . |
| 3-121851 | 5/1991 | Japan . |

*Primary Examiner*—John Barlow
*Assistant Examiner*—Michael Brooke
*Attorney, Agent, or Firm*—Fitzpatrick, Cella, Harper & Scinto

[57] ABSTRACT

A recording head comprises a recording element substrate on which a plurality of recording elements and first connecting electrodes connecting to the recording elements are disposed a driving element substrate on which a plurality of driving elements for driving the plurality of recording elements and second connecting electrodes connecting to the driving elements are disposed and a pressure welding member for producing a pressure welding force to pressure weld the recording element substrate and the driving element substrate together. The recording element substrate and the driving element substrate are pressure welded by the pressure welding member to connect the first connecting electrodes and the second connecting electrodes, with the recording element substrate sandwiched between the driving element substrate and the pressure welding member.

19 Claims, 24 Drawing Sheets

RECORDING HEAD, HAVING PRESSURE-BONDING MEMBER FOR BINDING RECORDING ELEMENT SUBSTRATE AND DRIVING ELEMENT SUBSTRATE, HEAD CARTRIDGE AND RECORDING APPARATUS HAVING SAME

BACKGROUND OF THE INVENTION

1. Field of the Invention

The present invention relates to a recording head comprising a recording element substrate having recording elements formed thereon, and a driving element substrate having driving elements formed thereon for driving recording elements in accordance with a signal input from the outside, both substrates being welded under pressure, a head cartridge having the head, and a recording apparatus on which the head is mounted.

2. Related Background Art

FIGS. 1A and 1B are views showing one structural example of a recording element unit within a conventional recording head, wherein FIG. 1A is a schematic structural view, and FIG. 1B is a cross-sectional view taken along 1B—1B in FIG. 1A.

This conventional example is comprised of an $HfB_2$ layer 1502 as a heating resistive layer for generating heat energy when electric current flows, a discrete electrode 1504 made of Al and a pattern electrode 1505 made of Al for supplying electric current to the $HfB_2$ layer 1502 from the outside, a pattern wiring 1505*b* made of Al and a common electrode 1503 made of Al for allowing electric current supplied to the $HfB_2$ layer 1502 to flow to the outside, a Ta layer 1508 as an anti-cavitation layer, an $SiO_2$ layer 1506 as an oxidation resistant layer as well as an insulating layer, a photosensitive polyimide layer 1507 as an oxidation resistant layer as well as an insulating layer, and a holding member 1501 for holding each component as above cited, as shown in FIGS. 1A and 1B.

In the recording element unit as above constituted, if electric current for driving recording elements is caused to flow from the outside, the electric current will flow via the discrete electrode 1504 and the pattern wiring 1505*a* into the $HfB_2$ layer 1502, and further via the pattern wiring 1505*b* and the common electrode 1503 to the outside, thereby generating heat energy in the $HfB_2$ layer 1502. And liquid is discharged by heat energy generated to effect the recording on the recording medium.

When the $HfB_2$ layer 1502, the discrete electrode 1504 and the pattern wirings 1505*a*, 1505*b* as above described are used in a combination (hereinafter referred to as a heating element), a plurality of heating elements are formed within one recording element unit in most cases, as shown in FIG. 1A.

Where a plurality of heating elements are provided within one recording elements unit, an ink jet recording apparatus for recording multiple dots simultaneously can be produced, thereby effecting the higher speed recording. Particularly, in recent years, the higher density and higher speed recording has been often demanded, and it is universal to perform the recording of one main scan line at a time, whereby a recording element unit having a number of heating elements arranged at high density has appeared.

As above described, when recording multiple dots simultaneously with a plurality of heating elements arranged within one recording element unit, each of the heating elements must be individually controlled to turn on or off.

However, though means for effecting the ON/OFF control of heating elements (hereinafter referred to as driving elements) can be formed within the recording element unit, when the driving elements are formed on the same substrate as the recording elements within the recording unit, it is apprehended that the overall recording unit will not operate, if any of the recording elements and driving elements causes failure partly, whereby the driving elements are usually formed on a separate substrate (hereinafter referred to as a driving element substrate), which is then connected to the recording element unit.

A method of electrically connecting a substrate on which the recording elements are formed and a driving element substrate has been disclosed in Japanese Laid-Open Patent Application No. 3-121851.

That method as disclosed in Japanese Laid-Open Patent Application No. 3-121851 is one in which a bump-like electrode is formed to protrude on the substrate for the discrete electrode for the recording element having substantially the same constitution as shown in FIGS. 1A and 1B, the substrate having the recording elements formed and the driving element substrate being joined by press bonding.

Also, another method of connecting the substrate on which the recording elements are formed and the driving element substrate has been disclosed in Japanese Laid-Open Patent Application No. 1-302829.

FIGS. 2A to 2C are views for explaining a method of electrically connecting the recording element substrate and the driving element substrate as disclosed in Japanese Laid-Open Patent Application No. 1-302829.

In this conventional example as shown in FIGS. 2A and 2B, the driving element substrate 1705 having an electrode portion 1715 and an insulating membrane 1719 and the recording element substrate 1704 having an electrode portion 1714 and an insulating membrane 1720 are placed oppositely via an electrical connecting member 1703 with an electrically conductive member 1717 held by a holding member 1718 (FIG. 2A), and then press bonded (FIGS. 2B and 2C) to allow the recording element substrate 1704 and the driving element substrate 1705 to be joined together.

Note that the pitch of arranging the electrically conductive member 1717 is set to be narrower than the pitch of arranging the electrodes 1714 and 1715.

FIG. 3 is a perspective view showing one constitutional example of a recording head for an ink jet recording apparatus according to the background art, which comprises a recording element substrate and a driving element substrate press bonded together.

This conventional example is comprised of the driving element substrate 2002 on which driving elements 2003 are formed, the recording element substrate 2001 on which recording elements (not shown) are formed, a circuit substrate 2004 electrically connected to the driving element substrate 2002 by a method such as wire bonding, a sub-base board 2005 for pressing down the driving element substrate 2002 and the circuit substrate 2004, a press-bonding plate 2007 for press bonding the driving element substrate 2002 and the recording element substrate 2001 via the sub-base board 2005 for electrical connection therebetween, an elastic member 2008 provided between the press-bonding plate 2007 and the sub-base board 2005, a ceiling plate 2011 provided on a portion of the surface of the recording element substrate 2001 out of contact with the driving element substrate 2002, a main base board 2006 for securing the recording element substrate 2001 by adhesives to hold down each of the above-cited components, securing screws 2010 for securing the press-bonding plate 2007 and the sub-base board 2005, and spacers 2009, as shown in FIG. 3.

Also, an ink chamber (not shown) is disposed between the recording element substrate 2001 and the ceiling plate 2011, and supplied with energy for discharging the ink to the ink chamber by the recording elements on the recording element substrate 2001.

A way of positioning the recording element substrate and the driving element substrate in press bonding as shown in FIG. 3 will be described below.

FIGS. 4A and 4B are views for illustrating one example of the way of positioning the recording element substrate and the driving element substrate in press bonding as shown in FIG. 3.

In press bonding the recording element substrate and the driving element substrate, a positioning jig base board 2106 provided with locating pins 2103 for locating the recording element substrate 2001 and locating pins 2104 for locating the driving element substrate 2002 at respective predetermined positions is employed, as shown in FIGS. 4A and 4B.

First, the main base board 2006 is placed on the positioning jig base board 2106, and then the recording element substrate 2001 is pressed onto the main base board 2006 with the recording element substrate 2001 in abutment against the locating pins 2103, in which state the recording element substrate 2001 is secured onto the main base board 2006 by adhesives (FIG. 4A).

Then, the driving element substrate 2002 and the recording element substrate 2001 are press bonded, with the sub-base board 2005 having the driving element substrate 2002 and the circuit substrate 2004 positioned and secured together in abutment against the locating pins 2104, to make connection between the electrodes (not shown) on the driving element substrate 2002 and the electrodes (not shown) on the recording element substrate 2001 (FIG. 4B).

However, the following problems are found in the previously described background art.

(1) In press bonding the driving element substrate onto the recording element substrate, because the sub-base board onto which the driving element substrate is secured is too large, with its connection of the driving element substrate with the recording element substrate being at the end portion off the center of gravity for the sub-base board, it is difficult to take parallel balance in press bonding the driving element substrate onto the recording element substrate.

Therefore, the workability in press bonding the driving element substrate onto the recording element substrate is bad, and the reliability of the unit is reduced.

(2) In press bonding the driving element substrate onto the recording element substrate, because the sub-base board onto which the driving element substrate is secured is too large, and positioning the driving element substrate in the direction orthogonal to the array direction of recording elements is made at the end portion of the sub-base board farthest from the connection of the driving element substrate with the recording element substrate, the distance for positioning from the locating pins to the connection is longer, resulting in the greater distance error. Therefore, it is apprehended that the positional deviation of the connection arises.

(3) When the recording element substrate is exchanged by any cause such as failure, it must be exchanged along with the main base board bonded to the recording element substrate, giving rise to the increased costs of renewal parts.

SUMMARY OF THE INVENTION

In the light of the aforementioned problems associated with the background art, an object of the present invention is to provide a recording head, a head cartridge, and a recording apparatus which are highly reliable, in which a recording element substrate and a driving element substrate are easily press bonded, with the less increased costs in exchanging the parts.

It is another object of the present invention to provide a recording head, a head cartridge and a recording apparatus in which in joining an energy generating element unit having energy generating elements for use in printing on the printing medium, and a driving element unit having driving elements for driving the energy generating elements together, the balance property and the close union between registration faces can be assured to effect the excellent electrical connection.

It is a further object of the present invention to provide a recording head comprising, a recording element substrate on which a plurality of recording elements and first connecting electrodes connecting to the recording elements are disposed, a driving element substrate on which a plurality of driving elements for driving the plurality of recording elements and second connecting electrodes connecting to the driving elements are disposed, and a pressure bonding member for producing a pressure bonding force to pressure bond the recording element substrate and the driving element substrate together, wherein the recording element substrate and the driving element substrate are pressure bonded by the pressure bonding member to connect the first connecting electrodes and the second connecting electrodes, with the recording element substrate sandwiched between the driving element substrate and the pressure bonding member.

It is another object of the present invention to provide a head cartridge comprising, a recording element substrate on which a plurality of recording elements and first connecting electrodes connecting to the recording elements are disposed, a driving element substrate on which a plurality of driving elements for driving the plurality of recording elements and second connecting electrodes connecting to the driving elements are disposed, and a pressure bonding member for producing a pressure bonding force to pressure bond the recording element substrate and the driving element substrate together, wherein the recording element substrate and the driving element substrate are pressure bonded together by the pressure bonding member to connect the first connecting electrodes and the second connecting electrodes, with the recording element substrate sandwiched between the driving element substrate and the pressure bonding member, the head cartridge further having a recording head for discharging the liquid by the use of energy generated by the recording elements, and a reservoir for reserving the liquid to be supplied to the recording head.

It is another object of the present invention to provide a recording apparatus having a mount portion for mounting a recording head comprising, a recording element substrate on which a plurality of recording elements and first connecting electrodes connecting to the recording elements are disposed, a driving element substrate on which a plurality of driving elements for driving the plurality of recording elements and second connecting electrodes connecting to the driving elements are disposed, and a pressure bonding member for producing a pressure bonding force to pressure bond the recording element substrate and the driving element substrate together, wherein the recording element substrate and the driving element substrate are pressure bonded together by the pressure bonding member to connect the first connecting electrodes and the second connecting electrodes, with the recording element substrate sandwiched between the driving element substrate and the pressure bonding member.

In the present invention as above constituted, since the recording element substrate is press bonded onto the driving element substrate presecured on the same base board as the circuit substrate, by means of a press-bonding plate, a movable member, i.e., a press bonding member, is smaller in size than conventionally, with the enhanced dynamic balance property in the press-bonding operation.

Also, if an interposing member having such a shape that when the recording element substrate is secured, its center of gravity is coincident to the position where the connecting electrodes are provided on the recording element substrate is provided between the recording element substrate and the press-bonding plate, the dynamic balance property in the press-bonding operation is further enhanced.

Thereby, the workability and the reliability can be enhanced, and the costs in exchanging the parts can be reduced.

Further, in one embodiment of the present invention, because an elastic member is provided between the recording element substrate and the press-bonding plate, the movable unit can be made smaller, thereby allowing stabler pressing operation to be performed.

In the present invention, if the interposing member is made of an electrically conductive material, the radiating effect of the recording elements and driving elements can be obtained.

Also, if the press-bonding plate is made of an electrically conductive material, it is unnecessary to provide new parts to obtain the radiating effect of recording elements and driving elements.

In a recording head having recording elements and driving elements formed on separate substrates, according to the present invention as above described, there is the effect that the electrical connection between the recording element substrate and the driving element substrate by pressure bonding can be made more easily and reliably.

According to the present invention, a full-line type recording head of long size, particularly with a plurality of discharge ports arranged over the entire width of recording on the recording medium, comprising the recording element substrate and the driving element substrate bonded under pressure together, which has been conventionally relatively difficult, can be easily obtained.

According to one embodiment of the present invention, since a thinner section is provided to shorten the gap between the registration face of energy generating element substrate and the pressing face thereof, the aspect ratio for connection can be improved over the conventional one, wherein the registration face of energy generating element substrate and the registration face of driving element unit can be securely contacted.

Also, since a groove is formed in the neighborhood of the pressing face to be unsusceptible to influence of warp caused by nonconforming shape, the registration face of energy generating element substrate and the registration face of driving element unit can be securely contacted.

As a result, the electrical connection between the energy generating element unit and the driving element unit can be further greatly enhanced in reliability and durability.

BRIEF DESCRIPTION OF THE DRAWINGS

FIGS. 1A and 1B are views showing one structural example of a recording element unit within a conventional recording head, wherein FIG. 1A is a schematic structural view, and FIG. 1B is a cross-sectional view taken along 1B—1B as shown in FIG. 1A.

FIGS. 5A and 5B are views showing one embodiment of a recording head of the present invention, wherein FIG. 5A is an appearance perspective view, and FIG. 5B is a side view.

FIGS. 7A and 7B are views showing another embodiment of a recording head of the present invention, wherein FIG. 7A is an appearance perspective view and FIG. 7B is a side view.

FIGS. 8A and 8B are views showing a further embodiment of a recording head of the present invention, wherein FIG. 8A is an appearance perspective view and FIG. 8B is a side view.

FIGS. 9A and 9B are views showing an ink jet recording head in a still further embodiment of the present invention, wherein FIG. 9A is an exploded view and FIG. 9B is a typical overall perspective view.

FIGS. 10A and 10B are views showing an ink jet recording head in a further embodiment of the present invention, wherein FIG. 10A is a typical overall perspective view and FIG. 10B is a typical perspective view of an elastic member.

FIGS. 11A and 11B are views showing an ink jet recording head in a further embodiment of the present invention, wherein FIG. 11A is a typical overall perspective view and FIG. 11B is a typical perspective view of an elastic member.

DETAILED DESCRIPTION OF THE PREFERRED EMBODIMENTS

The embodiments of the present invention will be described below with reference to the drawings.

Figure 5A:
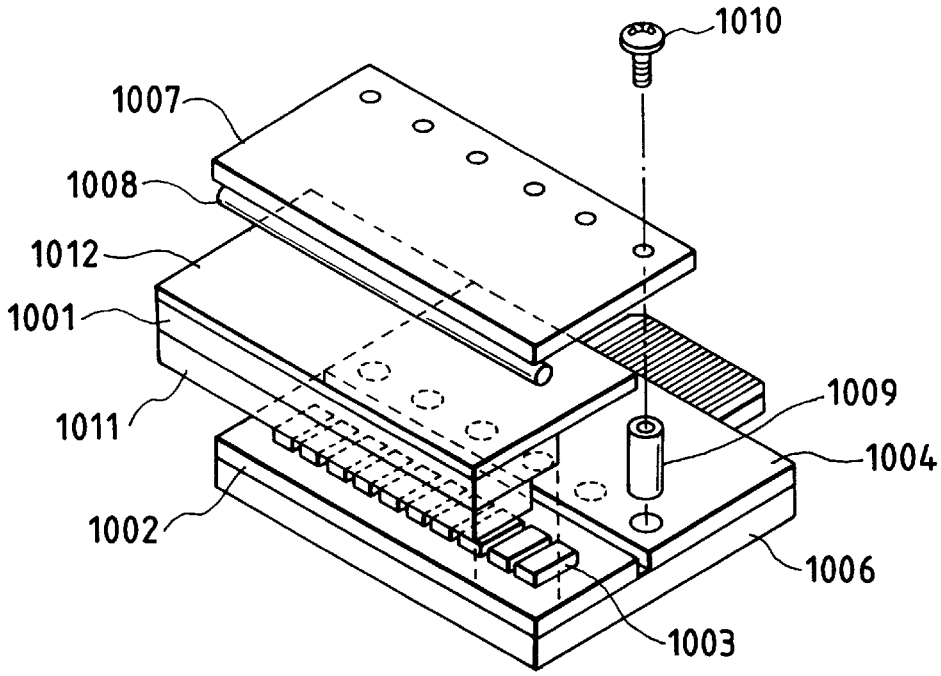
Figure 5B:
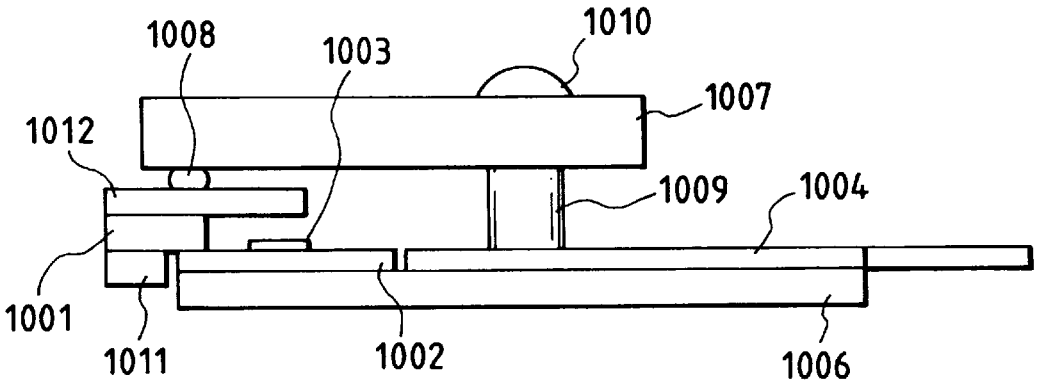

FIGS. 5A and 5B are views showing one embodiment of a recording head of the present invention, wherein FIG. 5A is an appearance perspective view and FIG. 5B is a side view.

This form is comprised of a recording element substrate 1001 on which recording elements (not shown) are formed, a driving element substrate 1002 on which driving elements 1003 of IC for driving the recording elements individually under control are formed, a circuit substrate 1004 electrically connected to the driving element substrate 1002 by a method such as wire bonding to enter an image signal from the outside into the driving elements 1003, a heat radiating plate 1012 provided for heat radiating the recording elements and driving elements on the recording element substrate 1001, a ceiling plate 1011 provided on a part of the face of the recording element substrate 1001 confronting the driving element substrate 1002, but out of contact with the driving element substrate 1002, a press-bonding plate 1007 for press bonding the recording element substrate 1001 and the driving element substrate 1002 to make electrical connection therebetween, an elastic member 1008 provided between the press-bonding plate 1007 and the heat radiating plate 1012, a main base board 2006 for holding down the driving element substrate 1002 and the circuit substrate 1004, securing screws 1010 for securing the press-bonding plate 1007 and the main base board 1006, and spacers 1009, as shown in FIGS. 5A and 5B.

The driving element substrate 1002 is positioned and fixed such that its end face may be flush with the end face of the main base board 1006.

Note that an ink chamber (not shown) and ink discharge ports (not shown) are disposed between the recording element substrate 1001 and the ceiling plate 1011, with energy for discharging the ink supplied to the ink chamber by the recording elements on the recording element substrate, so that the ink is discharged from the ink discharge ports owing to that energy.

Herein, a component consisting of the main base board 1006, the driving element substrate 1002 and the circuit substrate 1004 is referred to as a driving element unit, and a component consisting of the heat radiating plate 1012, the recording element substrate 1001 and the ceiling plate 1011 is referred to as a recording element unit.

A method of positioning the driving element unit and the recording element unit as shown in FIGS. 5A and 5B will be described below.

Figure 6A:
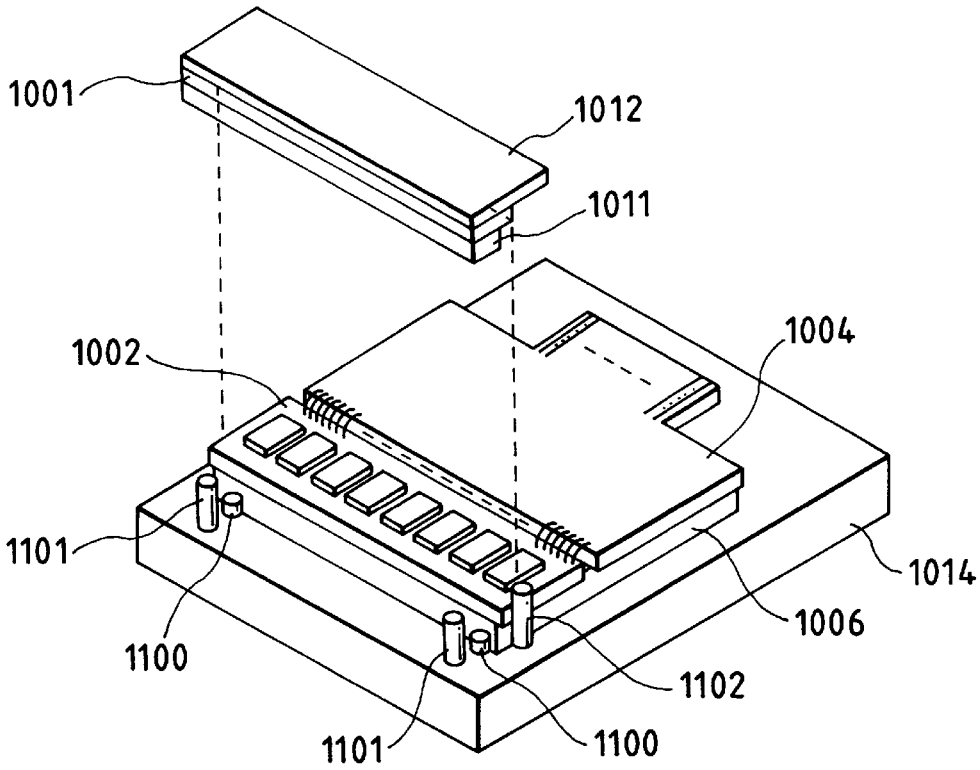
FIGS. 6A and 6B are views illustrating one form of a positioning method in press bonding the recording element unit and the driving element unit as shown in FIGS. 5A and 5B.
Figure 6B:
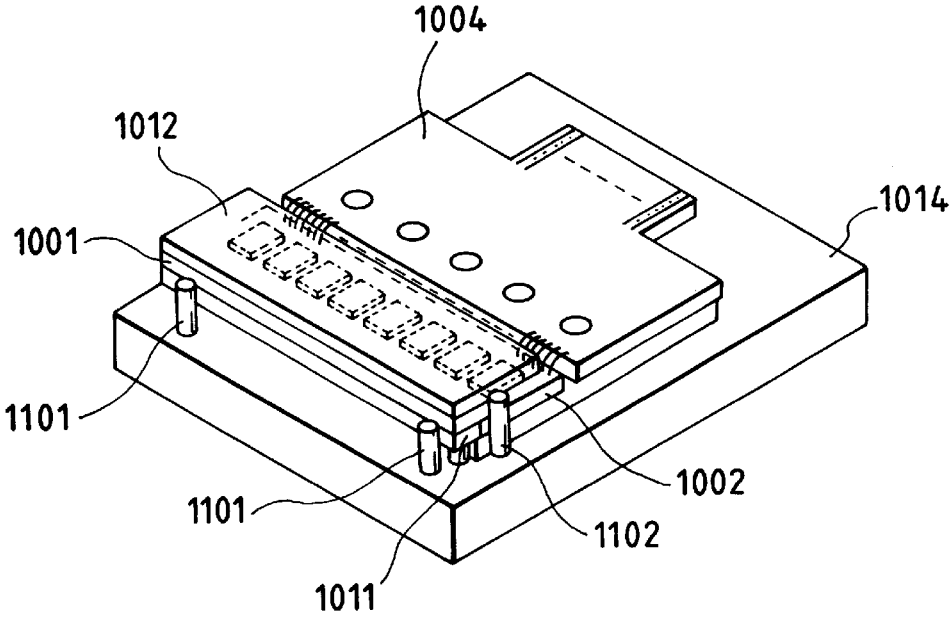

FIGS. 6A and 6B are views illustrating one form of the method of positioning the recording element unit and the driving element unit in press bonding, as shown in FIGS. 5A and 5B.

In press bonding the recording element unit and the driving element unit in this form, a positioning jig base board 1014 is used on which locating pins 1101, 1102 for locating the recording element unit and locating pins 1100, 1102 for locating the driving element unit are provided at respective predetermined positions, as shown in FIGS. 6A and 6B.

First, the driving element unit is placed on the positioning jig base board 1014, and secured thereto, with the end portion of the driving element unit abutted against the locating pins 1100, 1102 (FIG. 6A).

Then, the connection of the recording element unit is laid on the connection of the driving element unit, and the recording element unit is secured to the driving element unit, with the end portion of the recording element unit in abutment against the locating pins 1101, 1102 (FIG. 6B).

Herein, since the position of connecting electrodes for the driving element unit can be determined by the distance from the end of the driving element substrate 1002, and the position of connecting electrodes for the recording element unit can be determined by the distance from the end of the recording element substrate 1001, the position of the connecting electrodes for the driving element unit can be correctly determined by the locating pins 1100, 1102, and the position of the connecting electrodes for the recording element unit can be correctly determined by the locating pins 1101, 1102.

Thereafter, by disposing the elastic member 1008 on the heat radiating plate 1012, then laying the press-bonding plate 1007 thereon, and fixing to the spacers 1009 which are secured onto the main base board 1006, the driving element unit and the recording element unit are press bonded and electrically connected.

In the above for, the positioning of the driving element substrate and the recording element substrate can be easily made.

Figure 1A:
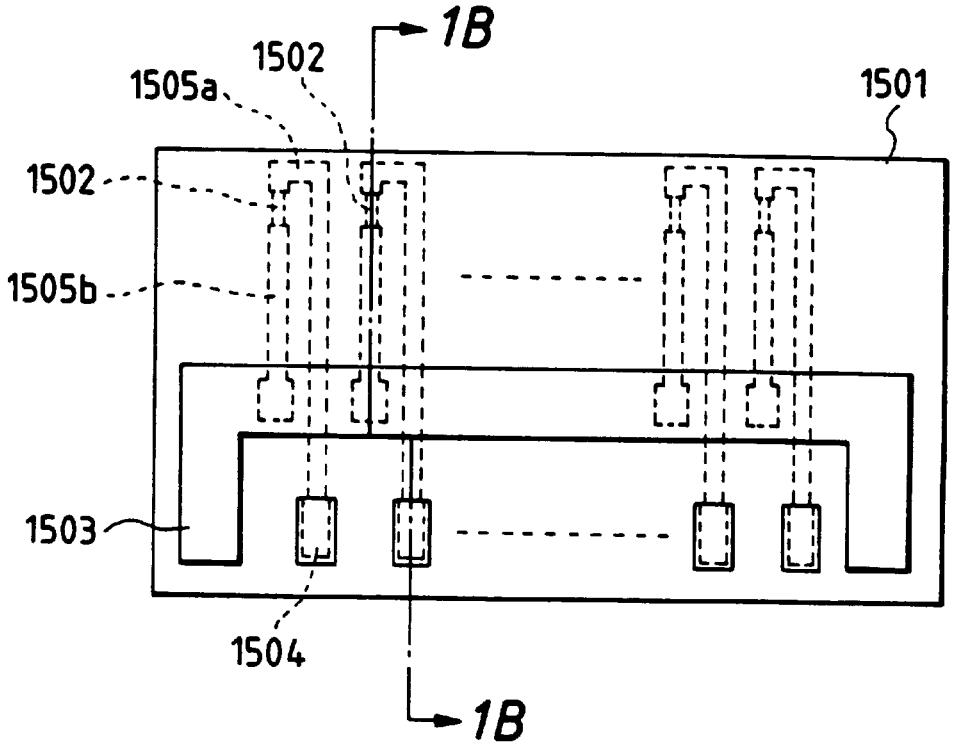
FIG. 1A PRIOR ART
Figure 1B:
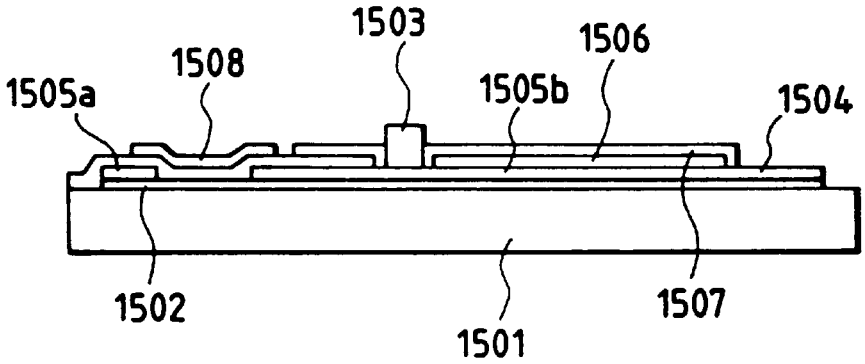
FIG. 1B PRIOR ART
Figure 2A:
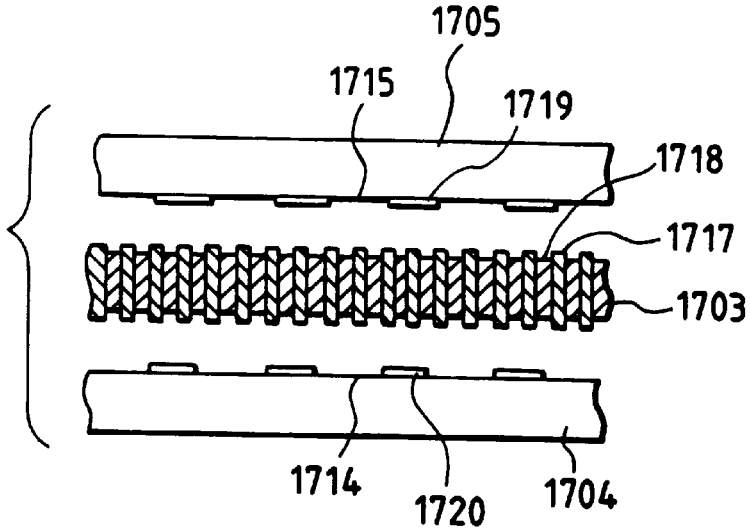
FIG. 2A PRIOR ART
FIGS. 2A to 2C are views for explaining a method of electrically connecting a recording element substrate and a driving element substrate as disclosed in Japanese Laid-Open Patent Application No. 1-302829.
Figure 2B:
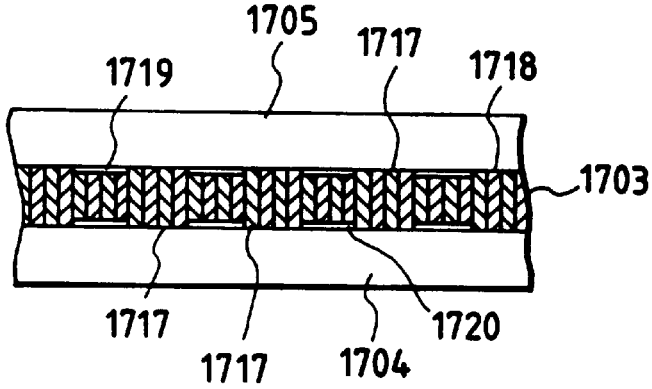
FIG. 2B PRIOR ART
Figure 2C:
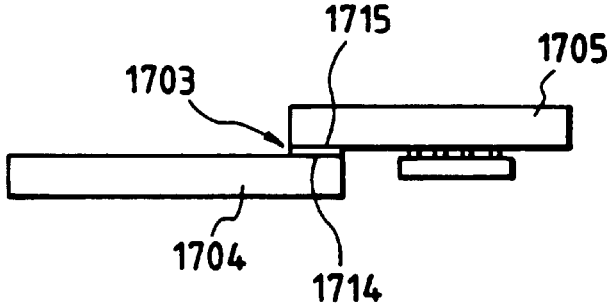
FIG. 2C PRIOR ART
Figure 3:
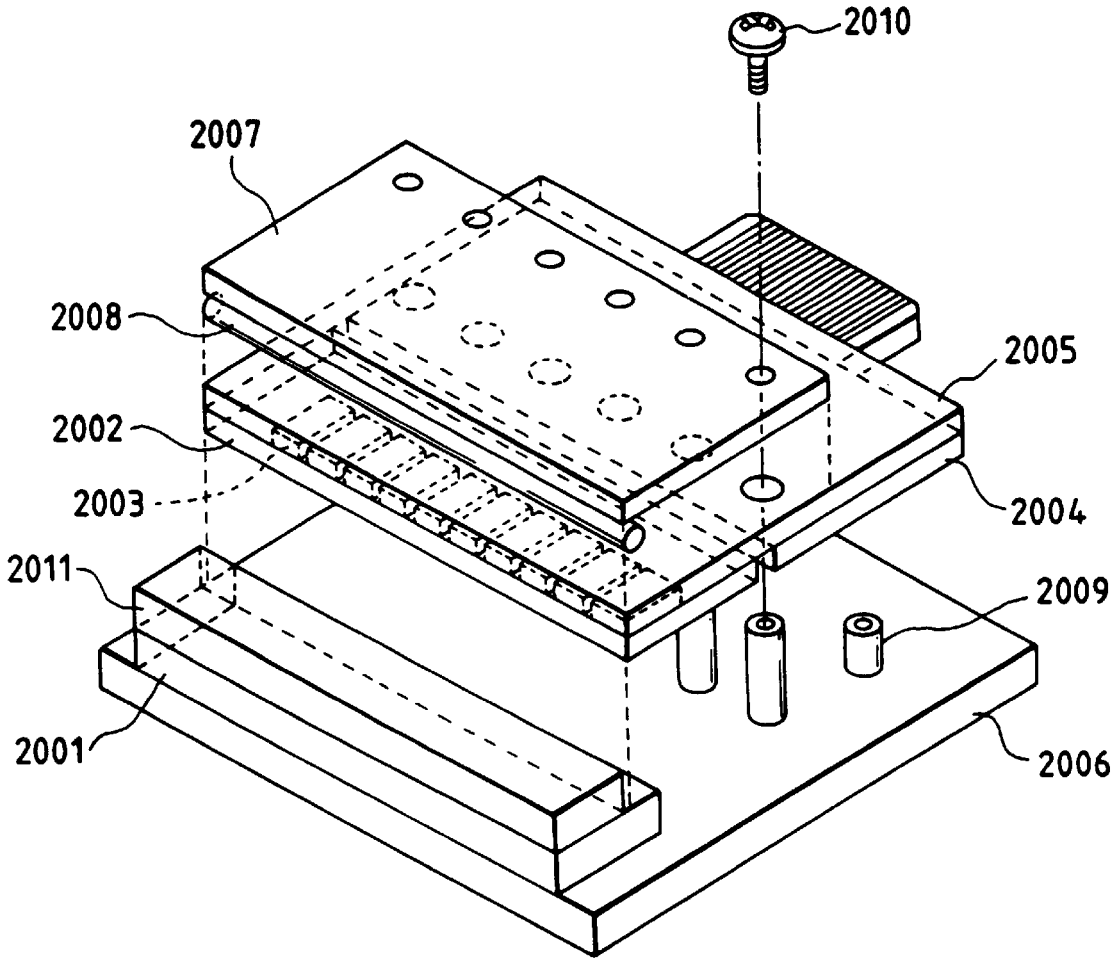
FIG. 3 PRIOR ART
FIG. 3 is a perspective view showing one constitutional example of a head portion of an ink jet recording apparatus according to the background art, comprising the recording element substrate and the driving element substrate bonded together under pressure.
Figure 4A:
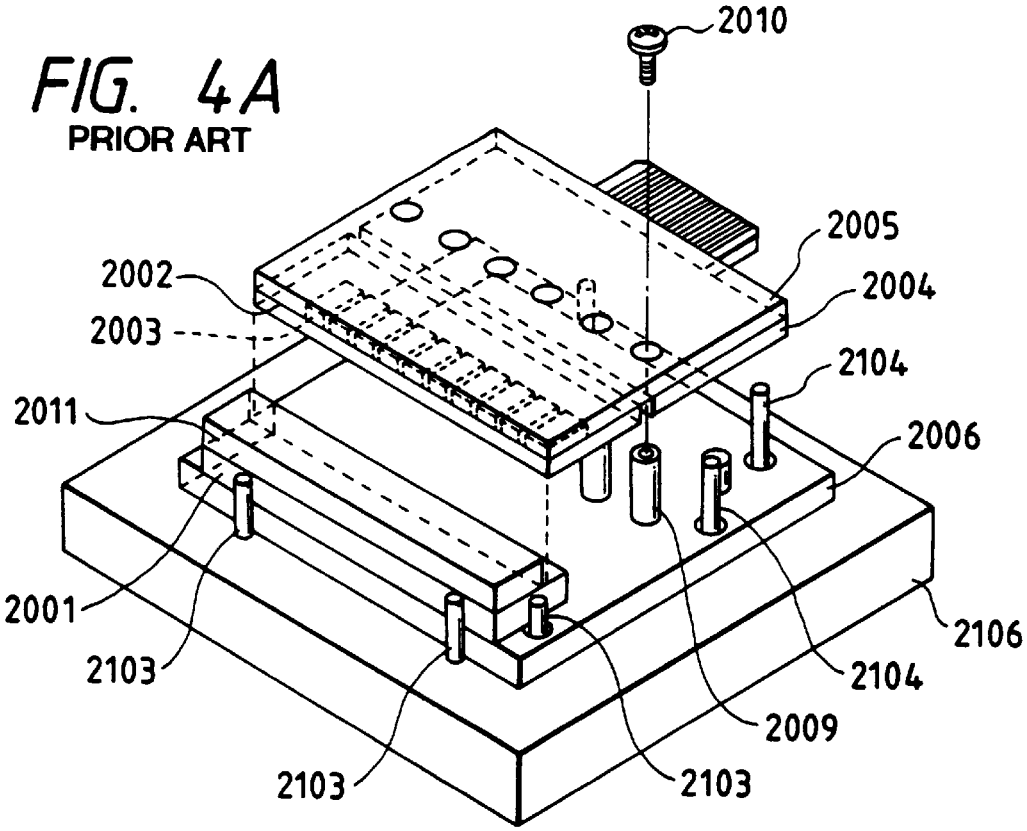
FIG. 4A PRIOR ART
FIGS. 4A and 4B are views illustrating one example of a positioning method in press bonding the recording element substrate and the driving element substrate as shown in FIG. 3.
Figure 4B:
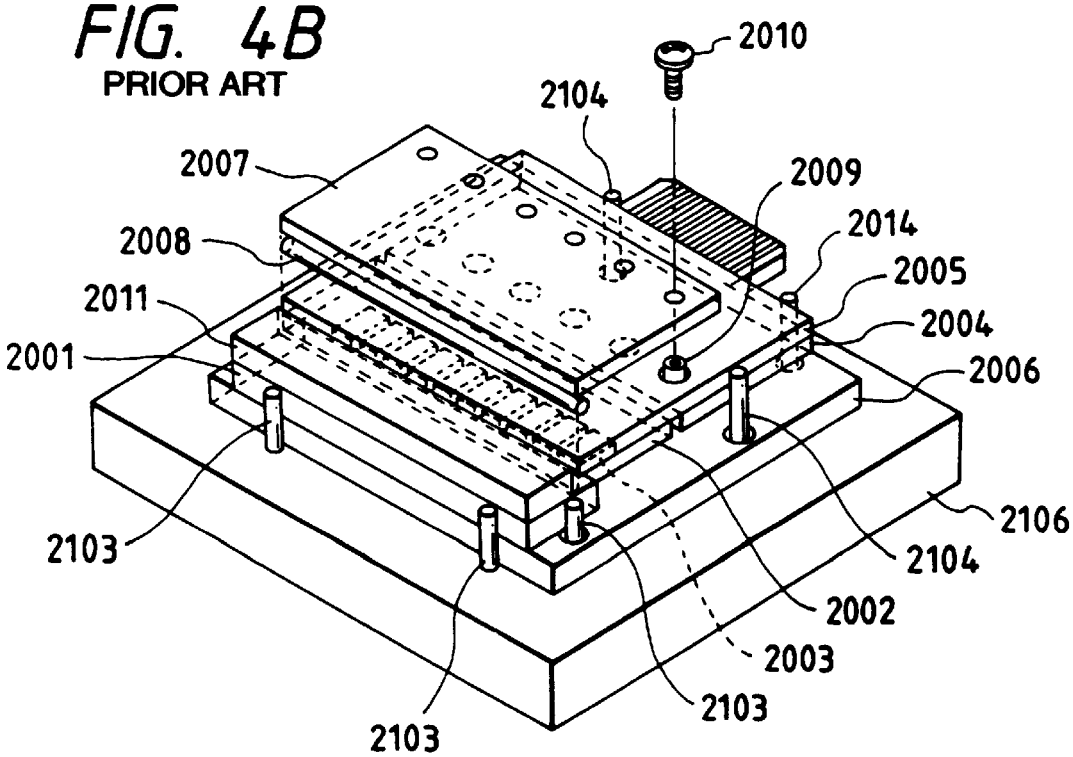
FIG. 4B PRIOR ART

Also, as opposed to the conventional example in which the elastic member 2008 is interposed between the sub-base board 2005 and the press-bonding plate 2007, as shown in FIG. 3, the elastic member 1008 is interposed between the recording element substrate 1001 and the press-bonding plate 1007 in this form, whereby the movable portion becomes the recording unit alone, resulting in superior dynamic balance in the operation and stabler pressure bonding operation.

Figure 7A:
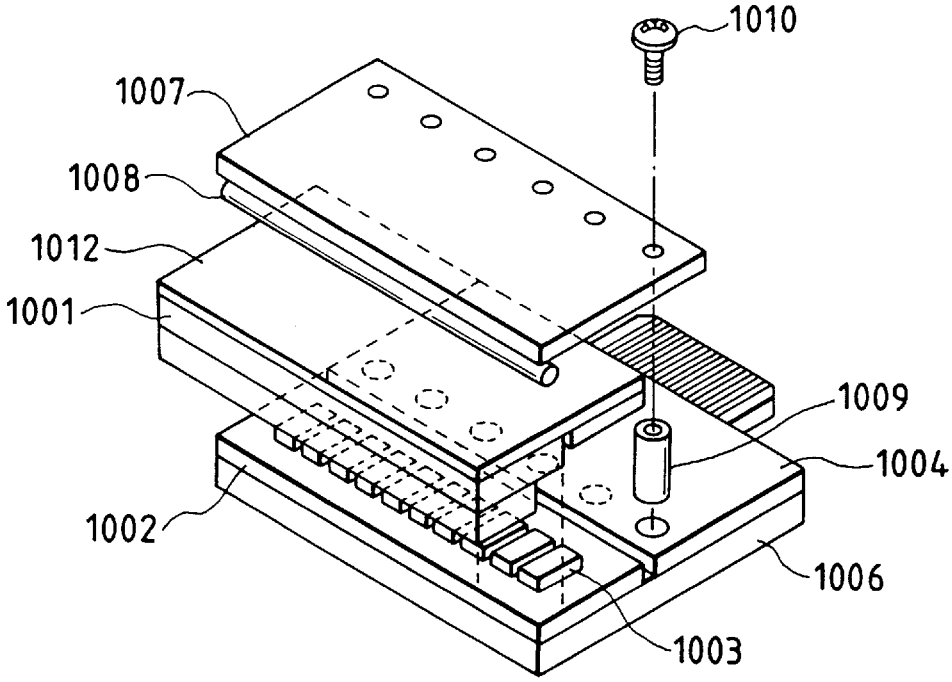
Figure 7B:
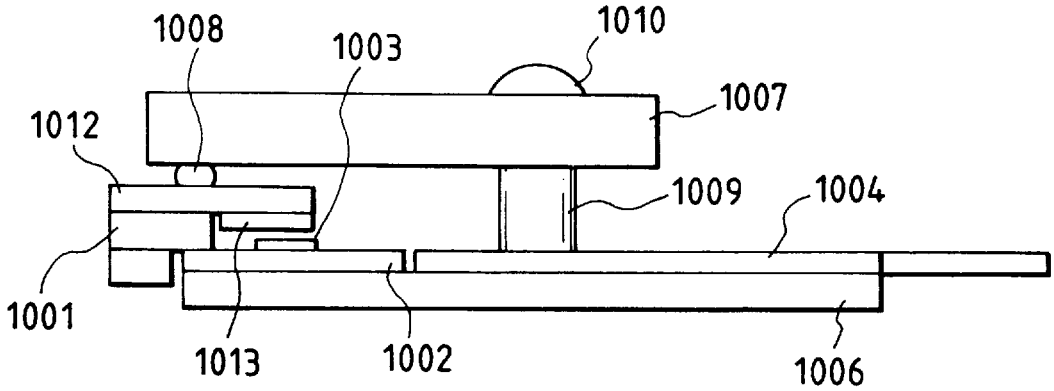

FIGS. 7A and 7B are views showing another embodiment of a recording head of the present invention, wherein FIG. 7A is an appearance perspective view and FIG. 7B is a side view.

This form has a balance weight 1013 attached to the heat radiating plate 1012 of the recording head as shown in the previous embodiment, as shown in FIGS. 7A and 7B.

In the previous embodiment, the recording element unit is constructed in such a manner that the recording element substrate 1001 and the ceiling plate 1011 are provided on one side from a column of connecting electrodes for the recording element substrate 1001 of the heat radiating plate 1012, none being provided on the other side, so that the position of the center of gravity in the recording element unit is offset relative to the position at which the connecting electrodes of the recording element substrate 1001 are provided. Accordingly, the dynamic balance is broken, in some instances leading to unstable and difficult operation, when positioning and press-bonding the recording element unit and the driving element unit.

Thus, in this form, the balance weight 1013 is attached oppositely to the side where the recording element substrate 1001 and the ceiling plate 1011 are provided with respect to the column of connecting electrodes for the recording element substrate 1001 on the heat radiating plate 1012, such that the position of the center of gravity in the recording element unit is substantially coincident with the installed position of the connecting electrode portion.

In the recording head as above constituted, due to the improved dynamic balance of the recording element unit in press bonding the recording element unit and the driving element unit, the press-bonding operation between the recording element unit and the driving element unit can be further enhanced in efficiency and reliability.

While this form has been described with an instance where the balance weight 1013 is attached to the heat radiating plate 1012, it will be appreciated that the position of the center of gravity in the recording element unit can be also substantially coincident with the installed position of the connecting electrode portion by changing the shape of the heat radiating plate 1012.

Figure 8A:
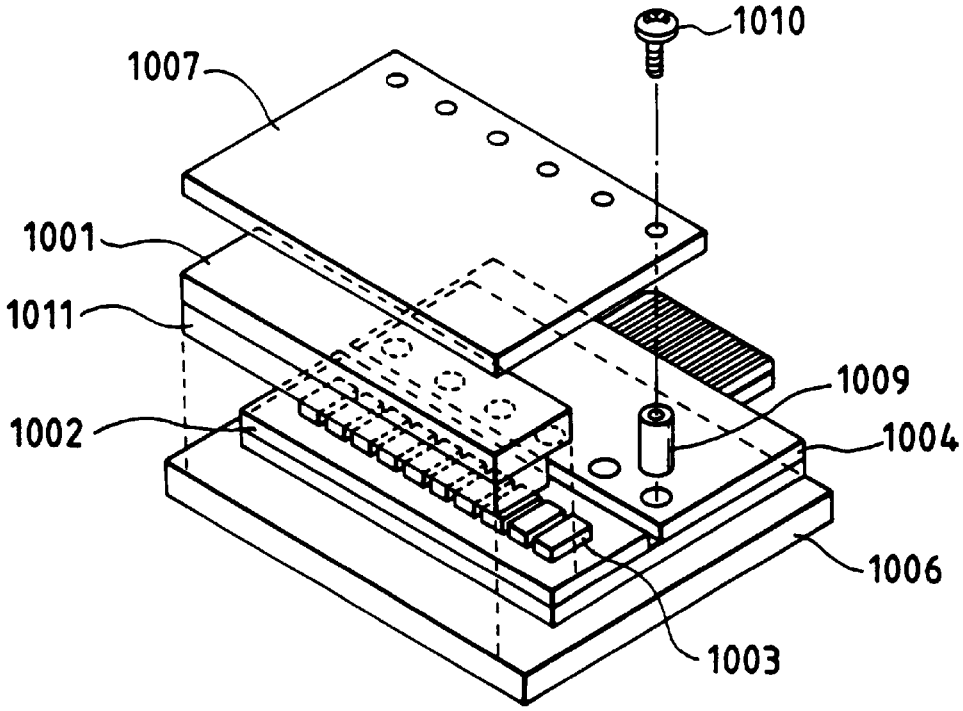
Figure 8B:
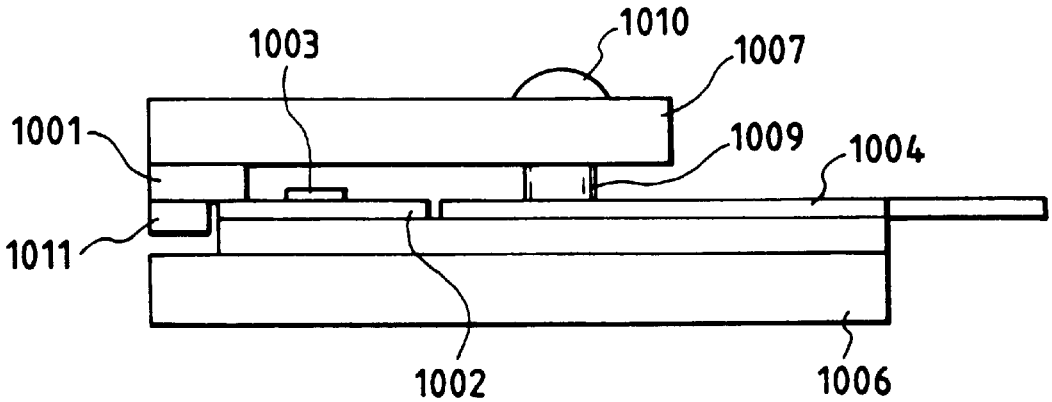

FIGS. 8A and 8B are views showing a further embodiment of a recording head of the present invention, wherein FIG. 8A is an appearance perspective view and FIG. 8B is a side view.

This form has no heat radiating plate 1012 for the recording head, which was provided in the previous embodiment, in which the press-bonding plate 1007 for use in press bonding the recording element unit to the driving element unit is made of an electrically conductive material to fill the role of heat radiating plate, as shown in FIGS. 8A and 8B.

In the recording head as above constituted, if the recording element substrate 1001 causes any failure, the recording element substrate 1001 can be only replaced, so that the number of parts and the number of assembling processes, as well as the costs of renewal parts, can be reduced.

Figure 9A:
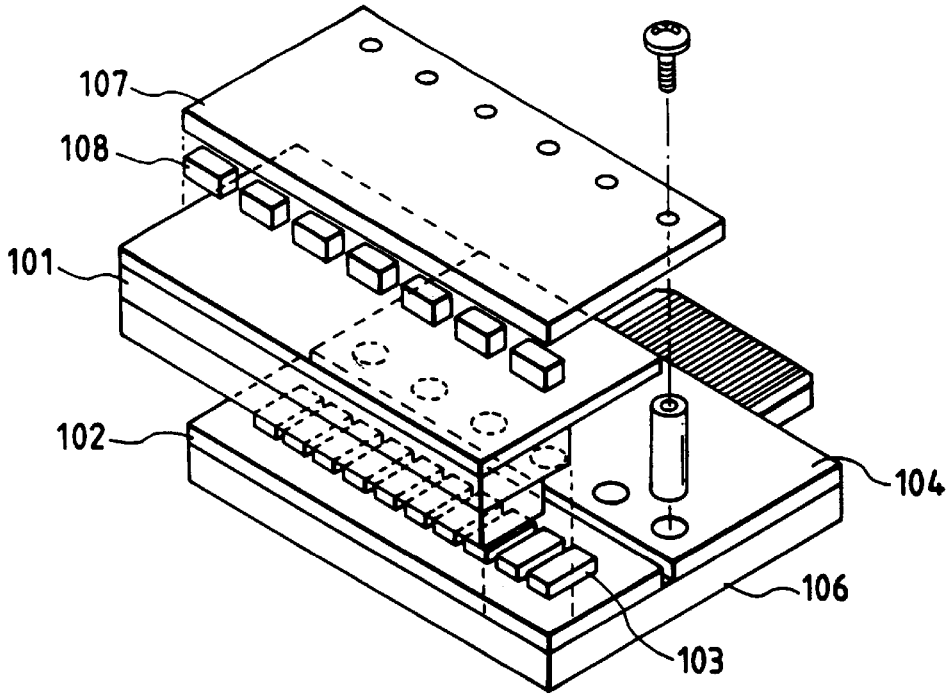
Figure 9B:
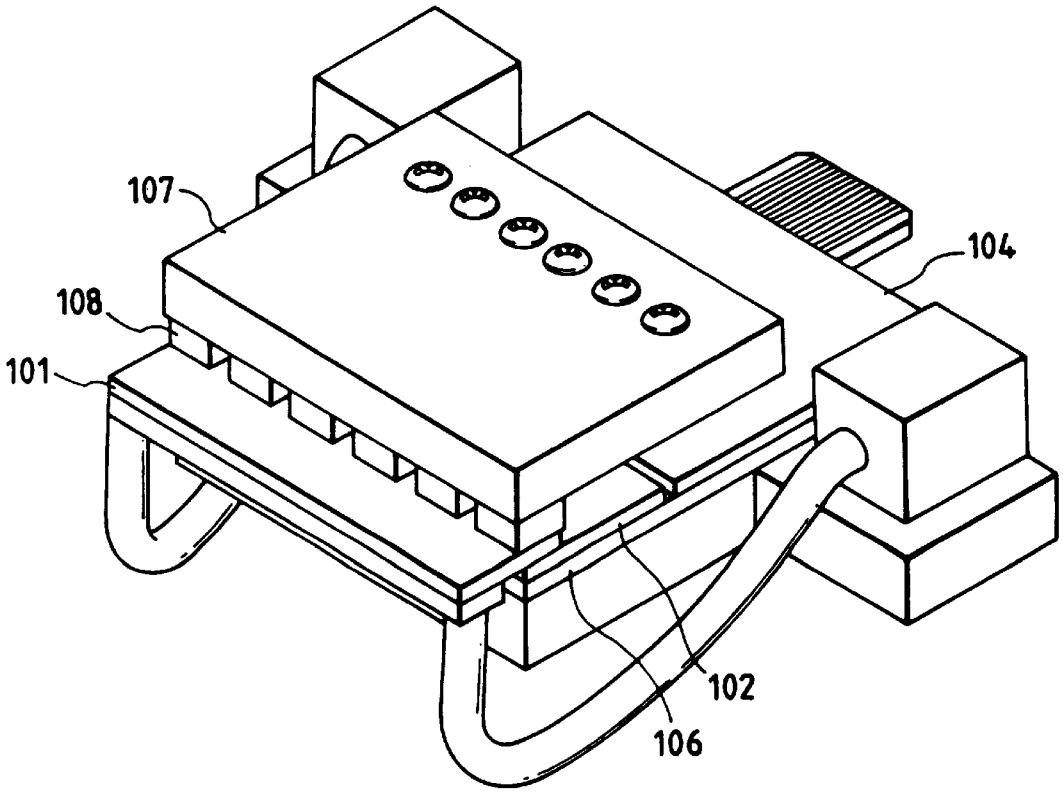

FIGS. 9A and 9B are views illustrating an ink jet recording head according to a further embodiment of the present invention, wherein FIG. 9A is an exploded view and FIG. 9B is an overall perspective view.

In FIGS. 9A and 9B, 101 is a recording element substrate on which recording elements, wirings and connecting electrodes, not shown, are disposed, 103 is a driving element of IC for driving each recording element under control, 102 is a driving element substrate on which the connecting electrodes for electrical connection with the recording element substrate and driving elements 103 are disposed, 104 is a circuit substrate for entering an image signal from the outside into driving elements 103, 106 is a main base board, 107 is a press-bonding plate, and 108 is an elastic member.

This example has a maximum feature that the elastic member 108 is divided into a plurality of blocks. The blocks of the elastic member 108 for use in this example are of e.g. rectangular parallelopiped shape and arranged on the course of transmitting a pressure welding force produced by the press-bonding plate 107. Therefore, the pressure bonding force produced by the press-bonding force 107 is transmitted to the pressure bonding face of the driving element substrate 102 and the recording element substrate 101, as a force applied to a number of points by the elastic members 108. As a result, the more reliable pressure welding can be effectively made more easily than by the conventional method, even if there is any warp or waviness of the substrate which is problematical in pressure welding the recording element substrate 101 and the driving element substrate 102 which are of long size.

Figure 10A:
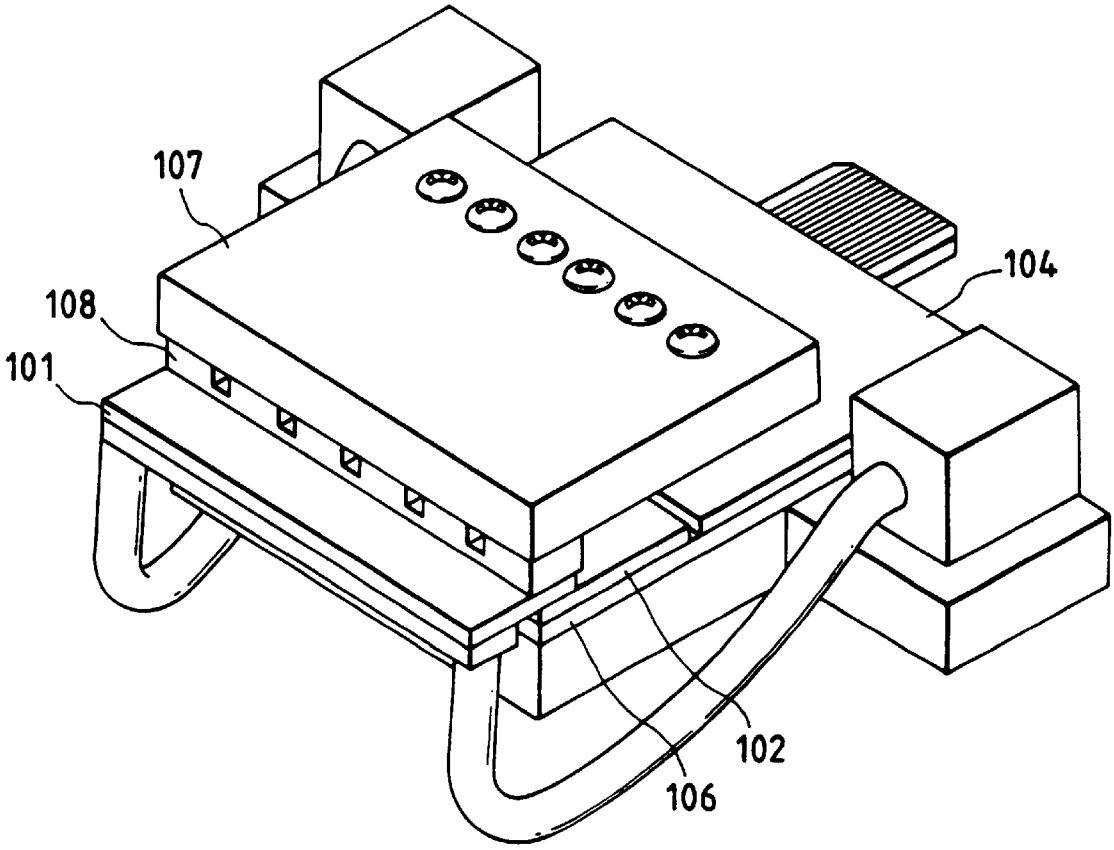
Figure 10B:
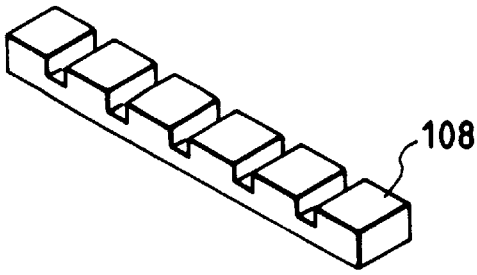

FIGS. 10A and 10B are views illustrating a further example of the present invention. FIG. 10A is an overall perspective view of an ink jet recording head of this example, and FIG. 10B is a typical view showing an elastic member 108 for use in this example. This example has the same constitution as the first example, except for the shape of the elastic member 108, wherein like numerals are attached, and no detailed explanation is given.

A different point between this example and the previous example is that the elastic member 108 is an elastic body of an integral structure having a plurality of convex and concave configurations, as shown in FIG. 10B. In this way, as the elastic member 108 is the integral structure, this example is superior in that the elastic member is more easily disposed, as compared with the first example where it was necessary to arrange a plurality of blocks of the elastic member 108. The material of this elastic member 108, like the previous example, is preferably natural rubber, silicone rubber, or other elastic resins, and the convex and concave configurations on the surface can be easily formed by a method such as stamping.

Figure 11A:
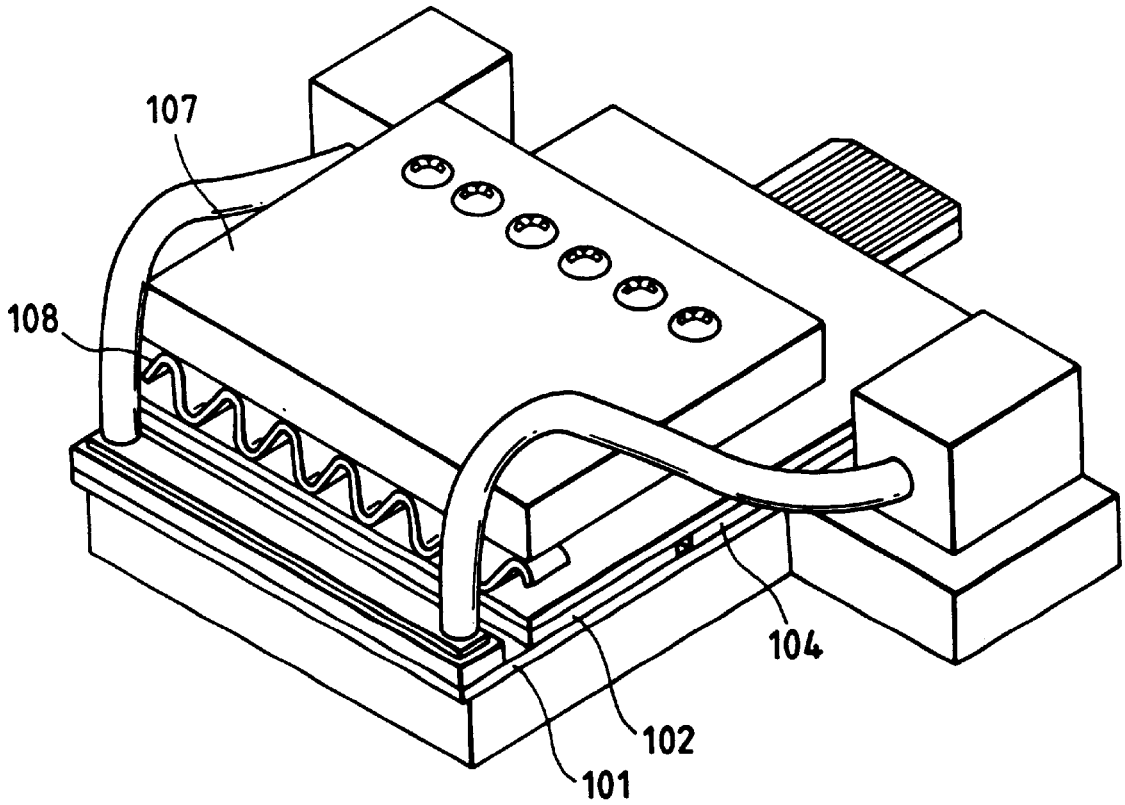
Figure 11B:
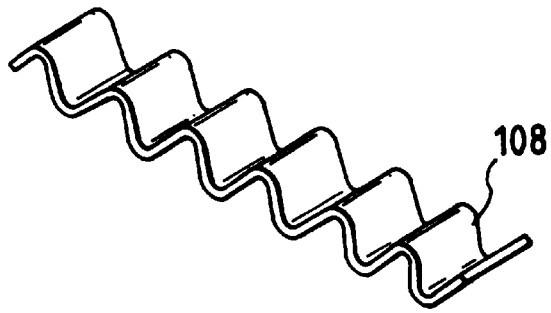

FIGS. 11A and 11B are views illustrating a further example of the present invention. FIG. 11A is an overall perspective view of an ink jet recording head of this example, and FIG. 11B is a typical view showing an elastic member 108 for use in this example. In this example, like numerals are attached to the same parts as in the previous example, and no detailed explanation is given. In this example, a different point from the previous example is that a metal sheet worked into a shape having convex and concave configurations such as wave or crest is employed, as shown in FIG. 11B.

The elastic member 108 of this example can be easily worked into wave or crest shape by a method such as press, with lower production costs of the recording head, and the use of metal parts allows the fabrication of recording head which is resistive to changes in environment such as temperature or humidity or secular deterioration.

Figure 12:
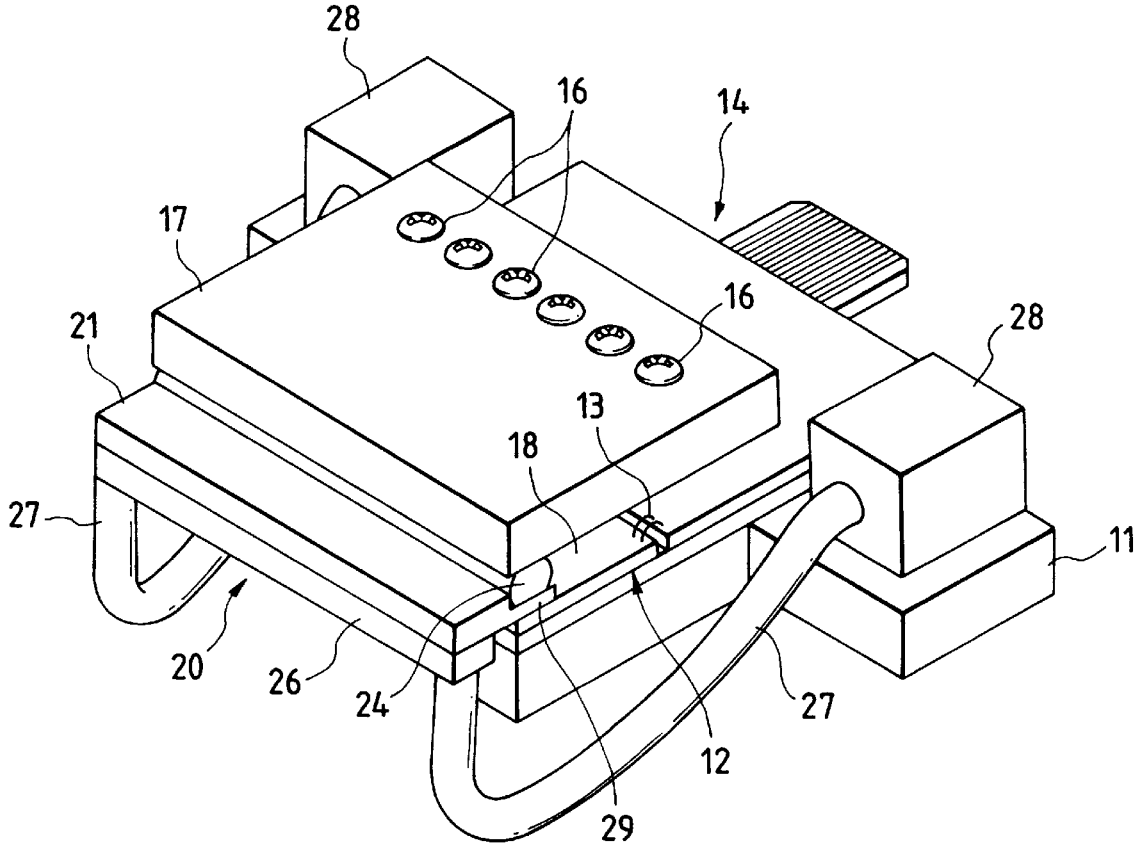
FIG. 12 is a perspective view showing an appearance of one embodiment of an ink jet head according to the present invention.
Figure 13:
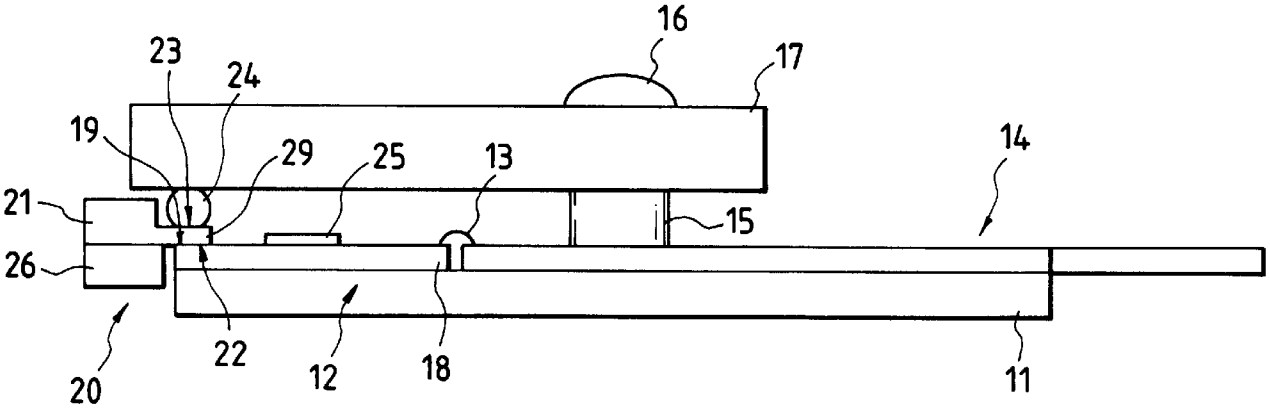
FIG. 13 is a side view of the ink jet head as shown in FIG. 12.
Figure 14:
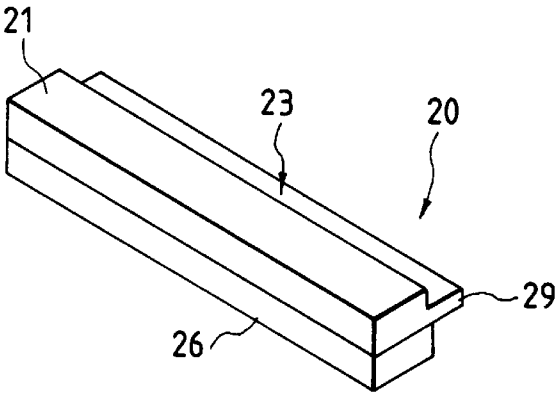
FIG. 14 is a perspective view representing the appearance of a portion of an energy generating element unit for the ink jet head as shown in FIGS. 12 and 13.

FIG. 12 shows an appearance of one embodiment of an ink jet head according to the present invention, FIG. 13 shows the lateral shape of its main portion, and FIG. 14 shows an appearance of a portion of an energy generating element unit thereof. That is, a driving element unit 12 and a circuit substrate 14 for electrical connection via wire bondings 13 to this driving element unit 12 are fixed on a base plate 11. Also, a base end portion of a presser bar 17 is attached to spacers 15 standing from the base plate 11 by means of a plurality of machine screws to be screwed into respective spacers.

A registration face 22 formed on an energy generating element substrate 21 of an energy generating element unit 20 is superposed on a registration face 19 formed on a driving element substrate 18 of the driving element unit 12. And a pressing face 23 formed on the opposite side of the registration face 22 of this energy generating element substrate 21 has a top end portion of the presser bar 17 pressed thereto via a cushion member 24 such as a rubber-like elastic material in circular cross section. Thereby, the registration face 22 of the energy generating element substrate 21 is pressed onto the registration face 19 of the driving element substrate 18 having driving elements formed, with the elastic deformation of the cushion member 24. Namely, pressing means of the present invention can be comprised of spacers 15, machine screws 16, the presser bar 17, and the cushion member 24, as above described.

On these registration faces 19, 22, there are exposed a plurality of connecting electrodes, not shown, which are electrically connected by positioning and bringing the registration faces 19, 22 of the energy generating element unit 20 and the driving element unit 12 into close union with each other.

On both sides of a grooved plate 26 joined to the registration face 22 of the energy generating element substrate 21 in a longitudinal direction thereof, a pair of ink supply tubes 27 for supplying the ink into an ink passageway, not shown, formed between the grooved plate 26 and the energy generating element substrate 21 are connected, the ink supply tubes 27 being in communication with an ink tank, not shown, via a filter device 28, whereby the ink supplied from this ink tank is filtered by the filter device 28 provided on the base plate 11 to prevent mixture of dust and foreign matter into the energy generating element unit 20.

On the base end of the energy generating element substrate 21 in this embodiment, a thinner portion 29 having a smaller thickness than the other portion is formed to employ the surface of this thinner portion 29 as the pressing face 23.

In this way, by placing the pressing face 23 into closer proximity to the registration face 22 by virtue of the thinner portion 29 of the energy generating element substrate 21 which is reduced in thickness, the aspect ratio for connection can be made greater than that of the conventional one. Also, since the thinner portion 29 which has smaller thickness and rigidity is used as the pressing face 23, the entire registration face 22 of the energy generating element substrate 21 can be securely brought into close union with the registration face 19 of the driving element substrate 18 by the pressing force of the presser bar 17, even if the energy generating element substrate 21 has more or less nonconforming shape such as warp. As a result, a stabler electrical connection can be made between the registration face 22 of the energy generating element substrate 21 and the registration face 19 of the driving element substrate 18.

Figure 15:
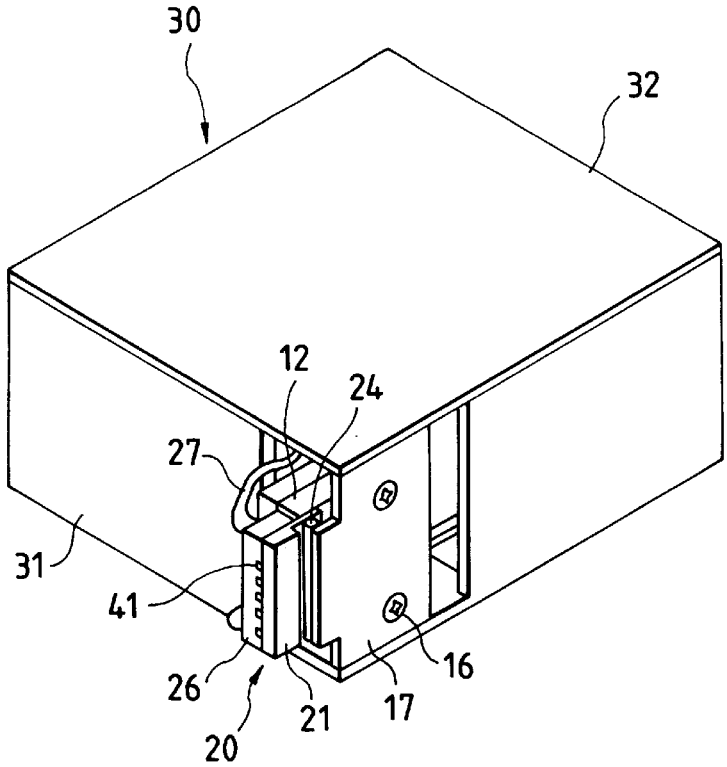
FIG. 15 is a perspective view representing the appearance of one embodiment of an ink jet cartridge according to the present invention.

FIG. 15 shows an appearance of one embodiment of an ink jet cartridge according to the present invention, using the ink jet head as above described. That is, the ink jet cartridge 30 in this embodiment is of the serial type, mainly comprised of a driving element unit 12, a presser bar 17, an energy generating element unit 20, a cushion member 24, an ink supply tube 27, a main ink tank 31 for storing the ink, and a lid member 32 for enclosing this main ink tank 31.

The energy generating element unit 20 having a number of ink discharge ports 41 discharging the ink formed, corresponding to the previous embodiment as shown in FIGS. 12 and 13, is pressed via the cushion member 24 onto the driving element unit 12 by the presser bar 17. The ink is passed from the main ink tank 31 through the ink supply tube 27 into an ink chamber which is formed by the grooved plate 26 and the energy generating element substrate.

While the ink jet cartridge 30 in this embodiment has the main ink tank 31 and the driving element unit 12 integrally formed, it will be appreciated that the main ink tank 31 may be exchangeably connected with the driving element unit 12.

Figure 16:
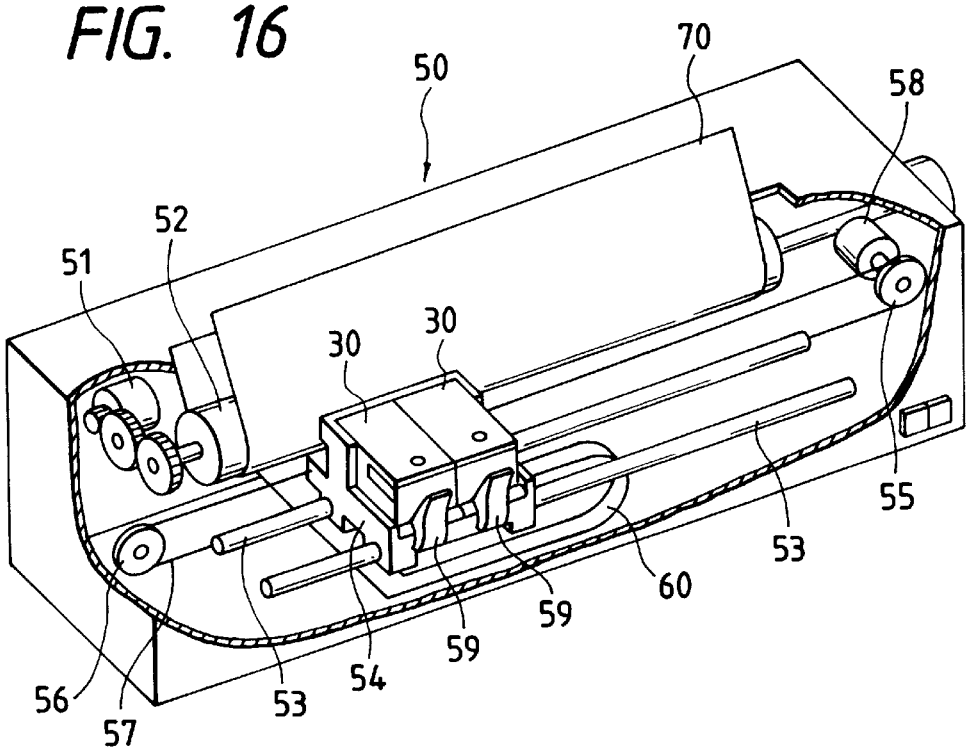
FIG. 16 is a perspective view representing the appearance of one embodiment of an ink jet apparatus according to the present invention, partially broken away.

FIG. 16 shows an appearance of one embodiment of an ink jet apparatus according to the present invention, using the ink jet cartridge 30 as above described. That is, the ink jet apparatus 50 of this embodiment has a carriage 54 freely slidable along a pair of guide bars 53 disposed in parallel to a platen roller 52 which is driven for rotation by a paper feeding motor 51. Also, a pair of pulleys 55, 56 rotatably attached beyond both ends of the guide bars 53 has a scanning wire 57 looped therearound in parallel to the guide bars 53, with its both trailing ends connected to the carriage 54. One pulley 55 is connected to a carriage driving motor 58, and with the forward and backward rotation of this carriage driving motor 58, the carriage 54 is moved for scanning along the platen roller 52 in its longitudinal direction, while being guided by the guide bars 53.

The carriage 54 has the ink jet cartridge 30 as shown in FIG. 15 mounted exchangeably by means of an operation lever 59 for mounting/dismounting in positioned state, the ink discharge ports 41 of the ink jet head 40 being placed oppositely to the printing medium 70 such as a sheet wrapped around the platen roller 52 with a predetermined spacing. Also, the driving elements 25 of the ink jet head 40 (see FIG. 13) are supplied with an ink discharge signal by way of a flexible cable 60 connecting to the carriage 54 in accordance with data from a proper data supply source. And owing to the feeding operation of the printing medium 70 by the paper feeding motor 51 and the scanning movement of the carriage 54 by the carriage driving motor 58, desired data can be printed on predetermined region of the printing medium 70.

Note that more than one ink jet cartridge 30 (two in the shown example) can be mounted on the carriage 54, in accordance with the ink colors in use. Also, while the ink jet head 40 as above described was of the serial type, it will be appreciated that the present invention can be also applied to an ink jet cartridge using an ink jet head of full-line type or an ink jet apparatus thereof.

Figure 17:
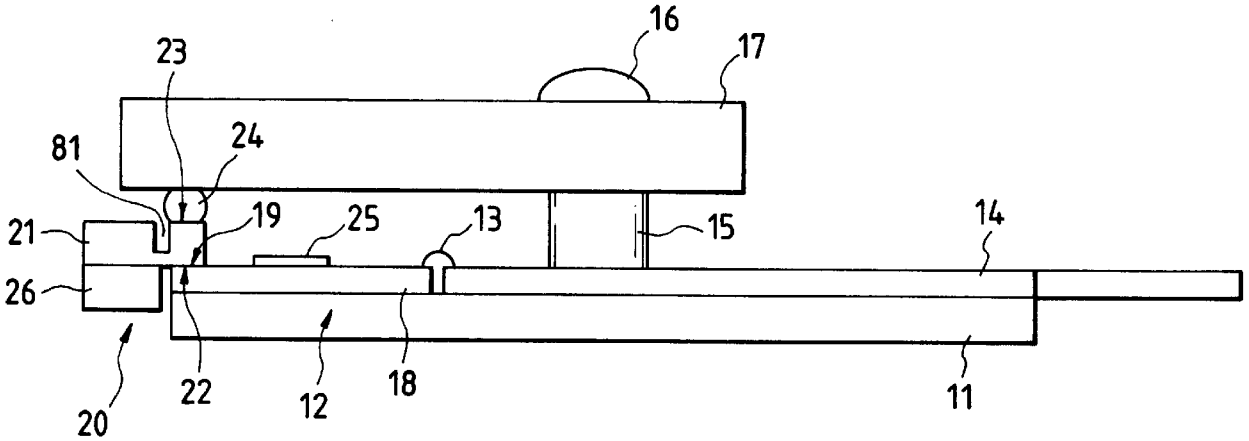
FIG. 17 is a side view representing the appearance of another embodiment of an ink jet head according to the present invention.
Figure 18:
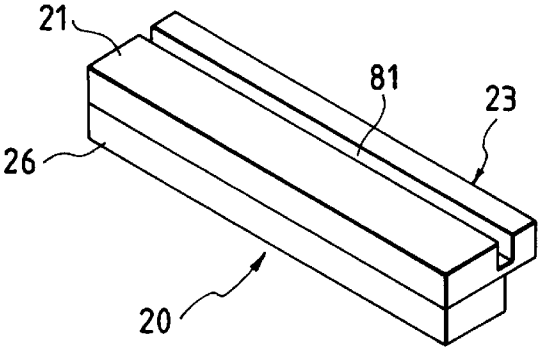
FIG. 18 is a perspective view representing the appearance of a portion of an energy generating element unit for the ink jet head as shown in FIG. 17.

In the embodiment as shown in FIGS. 12 to 14, the energy generating element substrate 21 was formed with the thinner portion 29, but the same effect can be also obtained by forming a groove. The lateral shape of another embodiment of an ink jet head according to the present invention is shown in FIG. 17, and an appearance of a portion of the energy generating element unit is shown in FIG. 18, wherein like numerals are attached to the same functional members or parts as in the previous embodiment, and no duplicate explanation is given.

This is, on the pressing face 23 of the energy generating element substrate 20, a groove portion 81 extending along this pressing face 23 is engraved, whereby since a portion of the energy generating element substrate 20 corresponding to this groove portion 81 is reduced in thickness and thus weak in rigidity, the entire registration face 22 of the energy generating element substrate 21 can be securely brought into close union with the registration face 19 of the driving element substrate 18 by the pressing force of the presser bar 17, even if there is more or less nonconforming shape such as warp in the energy generating element substrate 21. As a result, a stabler electrical connection between the registration face 22 of the energy generating element substrate 21 and the registration face 19 of the driving element substrate 18 can be made.

Figure 19:
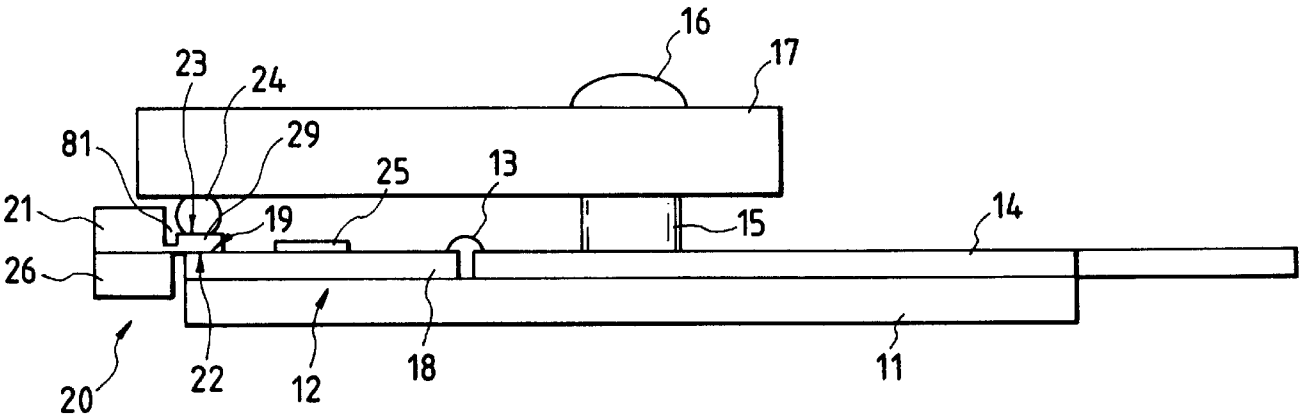
FIG. 19 is a side view representing the appearance of a further embodiment of an ink jet head according to the present invention.
Figure 20:
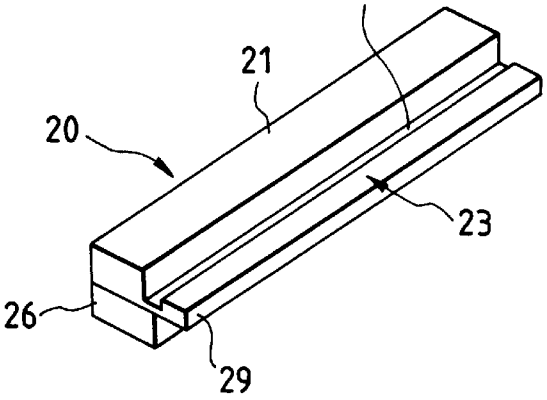
FIG. 20 is a perspective view representing the appearance of a portion of an energy generating element unit for the ink jet head as shown in FIG. 19.

Though the embodiments as shown FIGS. 12 to 14, FIG. 17 and FIG. 18 can be used in any combination, the lateral shape of another embodiment of such an ink jet head of the present invention is shown in FIG. 19, and an appearance of a portion of the energy generating element unit is shown in FIG. 20, wherein like numerals are attached to the same functional members or parts as in the previous embodiment, and no duplicate explanation is given.

That is, by forming the groove portion 81 on the thinner portion 29 of the energy generating element substrate 21, the entire registration face 22 of the energy generating element substrate 21 can be more securely brought into close union with the registration face 19 of the driving element substrate 18 than in the embodiment of FIGS. 12 to 14, even if there is more or less nonconforming shape such as warp in the energy generating element substrate 21, so that a stabler electrical connection between the registration face 22 of the energy generating element substrate 21 and the registration face 19 of the driving element substrate 18 can be made.

Figure 21:
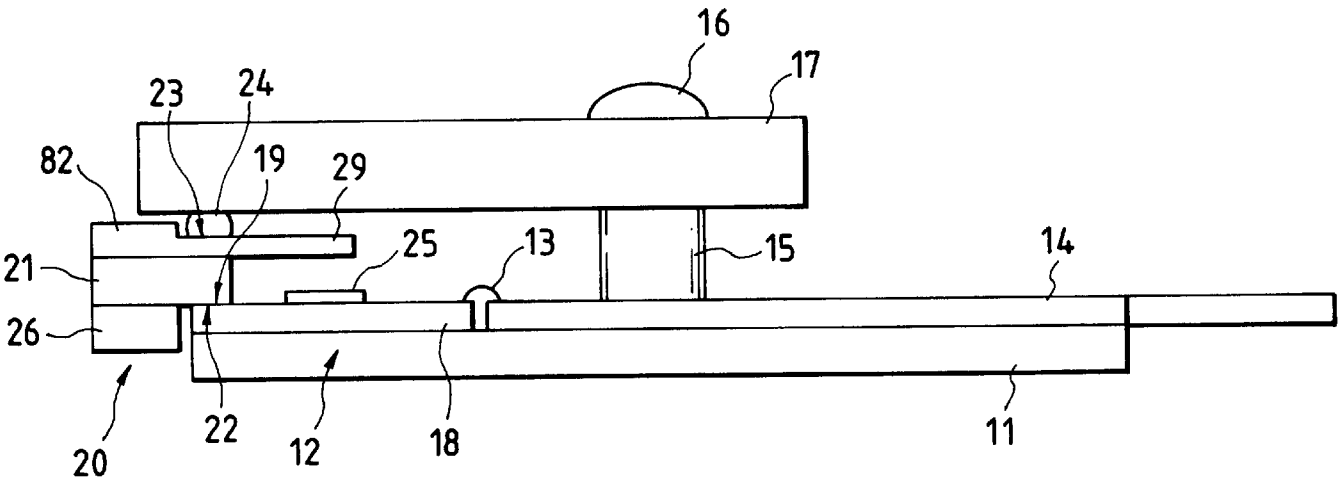
FIG. 21 is a side view representing the appearance of a still further embodiment of an ink jet head according to the present invention.
Figure 22:
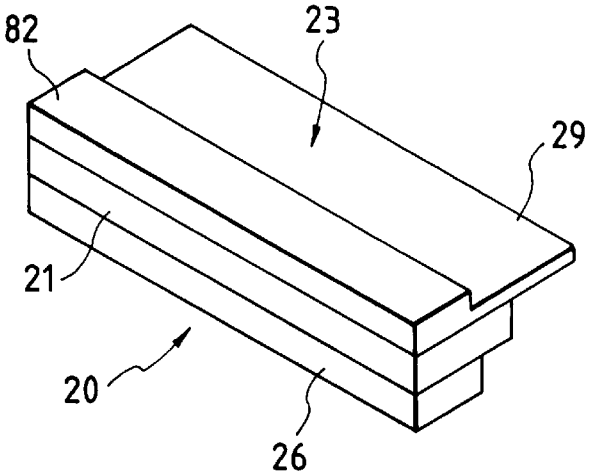
FIG. 22 is a perspective view representing the appearance of a portion of an energy generating element unit for the ink jet head as shown in FIG. 21.

Then, the lateral shape of a further embodiment of an ink jet head according to the present invention having a support plate incorporated into the energy generating element unit 20 is shown in FIG. 21, and an appearance of a portion of the energy generating element unit is shown in FIG. 22. In this case, like numerals are attached to the same functional members or parts as in the previous embodiment, and no duplicate explanation is given.

That is, the support plate 82 for assuring the rigidity of the energy generating element unit 20 is integrally joined to the energy generating element substrate 21 of the energy generating element unit 20. The support plate 82 which is wider than the energy generating element substrate 21 is formed with the thinner portion 29 which is smaller in thickness, the surface of this thinner portion 29 being employed as the pressing face 23 against which the cushion member 24 is abutted.

In this way, by placing the pressing face 23 into closer proximity to the registration face 22 of the energy generating substrate 21 with the thinner portion 29 of the support plate 82, the aspect ratio for connection can be made greater than conventionally. Also, since the thinner portion 29 which has smaller thickness and reduced rigidity is used as the pressing face 23, the entire registration face 22 of the energy generating element substrate 21 can be securely brought into close union with the registration face 19 of the driving element substrate 18 by the pressing force of the presser bar 17, even if the energy generating element substrate 21 or the support plate 82 has more or less nonconforming shape such as warp. As a result, a stabler electrical connection can be made between the registration face 22 of the energy generating element substrate 21 and the registration face 19 of the driving element substrate 18.

Figure 23:
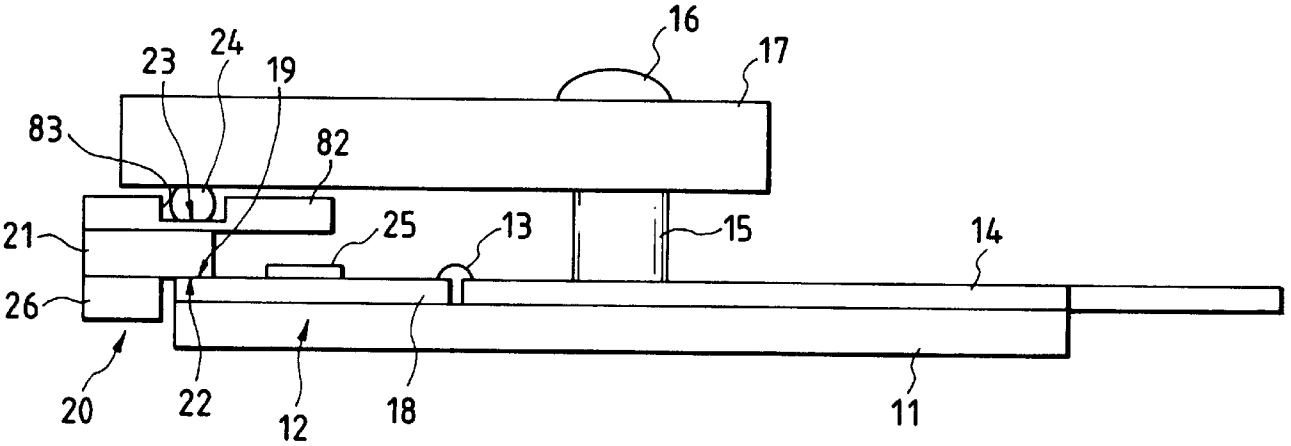
FIG. 23 is a side view representing the appearance of a still further embodiment of an ink jet head according to the present invention.
Figure 24:
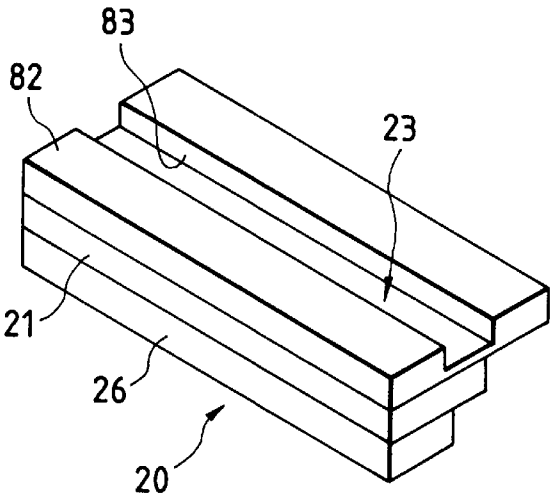
FIG. 24 is a perspective view representing the appearance of a portion of an energy generating element unit for the ink jet head as shown in FIG. 23.

While in the above embodiment, the thinner portion 29 is formed in the support plate 82, a portion of which is used as the pressing face 23, it will be appreciated that a receiving groove in which the cushion member 24 is only received can be formed in the support plate 82, and the lateral shape of a further embodiment of such an ink jet head of the present invention is shown in FIG. 23, and an appearance of a portion of its energy generating element unit is shown in FIG. 24, wherein like numerals are attached to the same functional members or parts as in the previous embodiment, and no detailed explanation is given.

That is, a cushion member receiving groove 83 is formed in the central portion of the support plate 82 against which the cushion member 24 is pressed, the bottom face for this cushion member receiving groove 83 being used as the pressing face 23.

In this way, by forming the cushion member receiving groove 83 in the central portion of the support plate 82, the pressing face 23 can be brought into closer proximity to the registration face 22 of the energy generating element substrate 21 than in the previous embodiment, without losing the rigidity of the support plate 82. Accordingly, in this embodiment, the aspect ratio for connection can be made greater than conventionally, whereby the entire registration face 22 of the energy generating element substrate 21 can be securely brought into close union with the registration face 19 of the driving element substrate 18 by the pressing force of the presser bar 17, even if there is more or less nonconforming shape such as warp in the energy generating element substrate 21 or the support plate 82, so that a stabler electrical connection can be made between the registration face 22 of the energy generating element substrate 21 and the registration face 19 of the driving element substrate 18.

Figure 25:
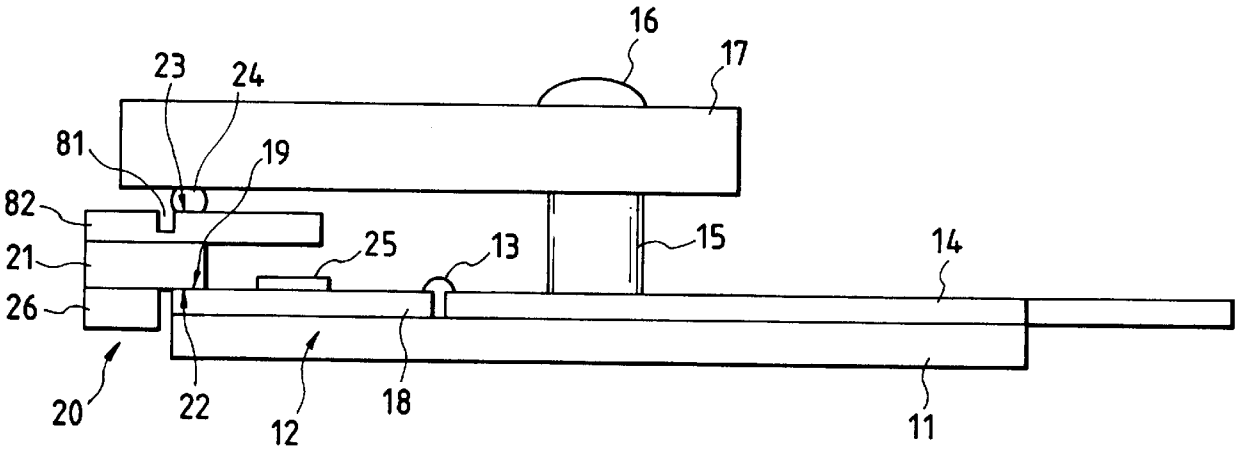
FIG. 25 is a side view representing the appearance of a still further embodiment of an ink jet head according to the present invention.
Figure 26:
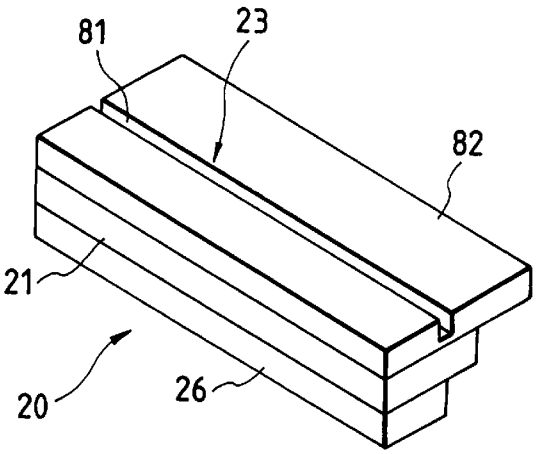
FIG. 26 is a perspective view representing the appearance of a portion of an energy generating element unit for the ink jet head as shown in FIG. 25.

In one embodiment of the present invention as above described, the cushion member receiving groove 83 for receiving the cushion member 24 was formed in the support plate 82, but the same effect can be also obtained by forming a groove adjacent to the pressing face 23. The lateral shape of a further embodiment of such an ink jet head of the present invention is shown in FIG. 25, and an appearance of a portion of its energy generating element unit is shown in FIG. 26, wherein like numerals are attached to the same functional members or parts as in the previous embodiment, and no detailed explanation is given.

That is, on the pressing face 23 of the support plate 82 is engraved a groove portion 81 extending along this pressing face 23, whereby since a portion of the support plate 82 corresponding to this groove portion 81 is reduced in thickness and thus rigidity, the entire registration face 22 of the energy generating element substrate 21 can be securely brought into close union with the registration face 19 of the driving element substrate 18 by the pressing force of the presser bar 17, even if there is more or less nonconforming shape such as warp in the support plate 82. As a result, a stabler electrical connection between the registration face 22 of the energy generating element substrate 21 and the registration face 19 of the driving element substrate 18 can be made.

Figure 27:
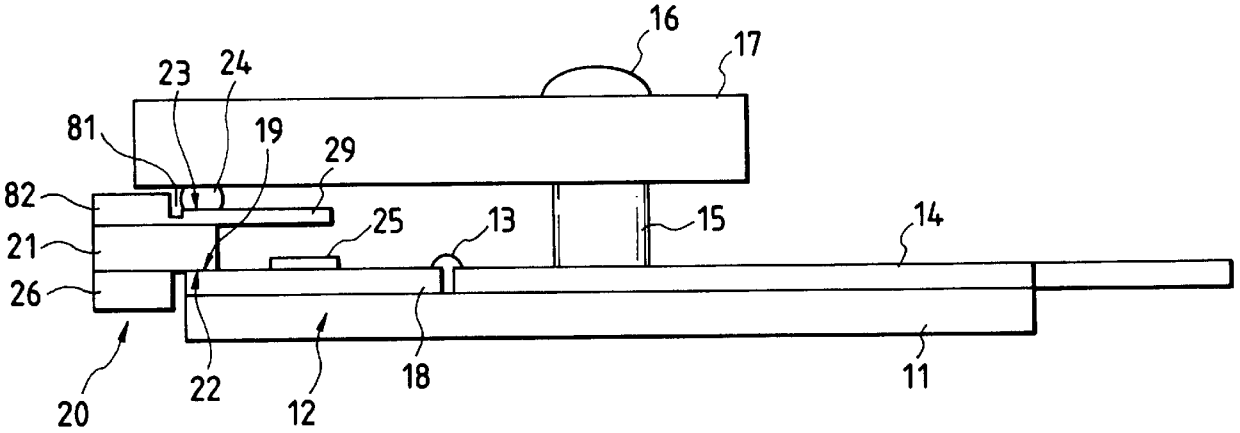
FIG. 27 is a side view representing the appearance of a still further embodiment of an ink jet head according to the present invention.
Figure 28:
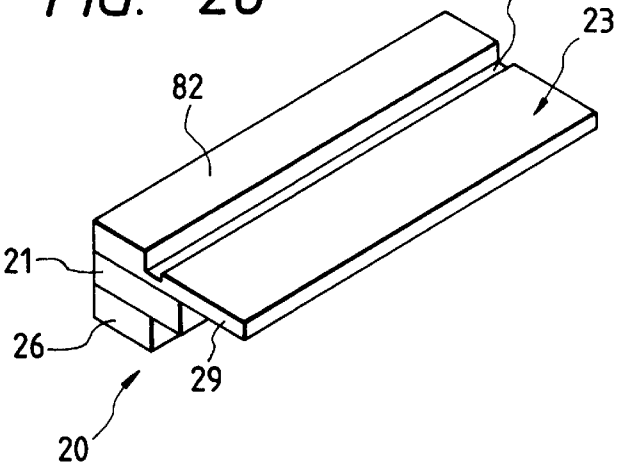
FIG. 28 is a perspective view representing the appearance of a portion of an energy generating element unit for the ink jet head as shown in FIG. 27.

Though the embodiments as shown FIGS. 21 to 22 and FIGS. 25 to 26 can be used in any combination, the lateral shape of another embodiment of such an ink jet head of the present invention is shown in FIG. 27, and an appearance of a portion of the energy generating element unit is shown in FIG. 28, wherein like numerals are attached to the same functional members or parts as in the previous embodiment, and no duplicate explanation is given.

That is, by forming the groove portion 81 on the thinner portion 29 of the support plate 82, the entire registration face 22 of the energy generating element substrate 21 can be more securely brought into close union with the registration face 19 of the driving element substrate 18 than in the fourth embodiment as shown in FIGS. 21 to 22, even if there is more or less nonconforming shape such as warp in the support plate 82, so that a stabler electrical connection between the registration face 22 of the energy generating element substrate 21 and the registration face 19 of the driving element substrate 18 can be made.

Figure 29:
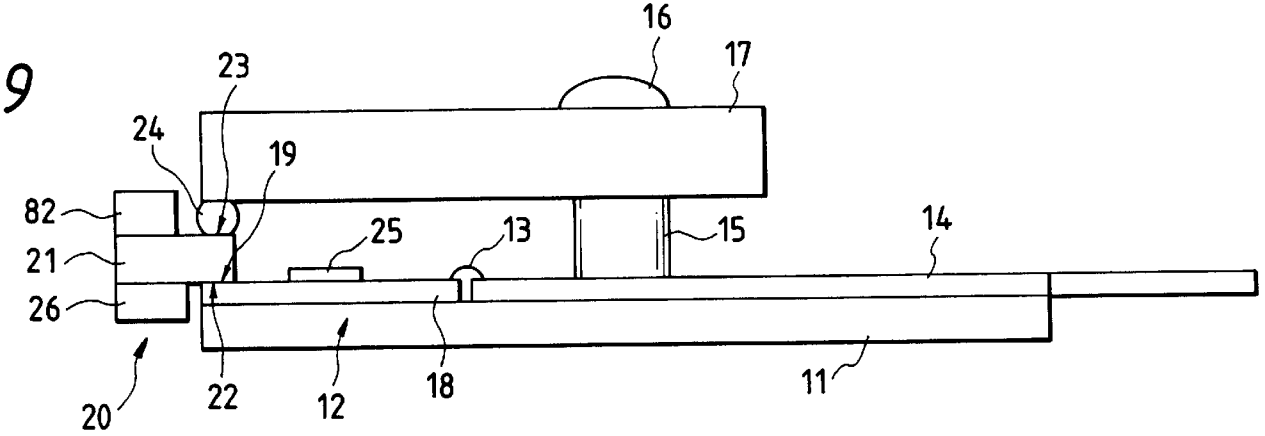
FIG. 29 is a side view representing the appearance of a still further embodiment of an ink jet head according to the present invention.
Figure 31:
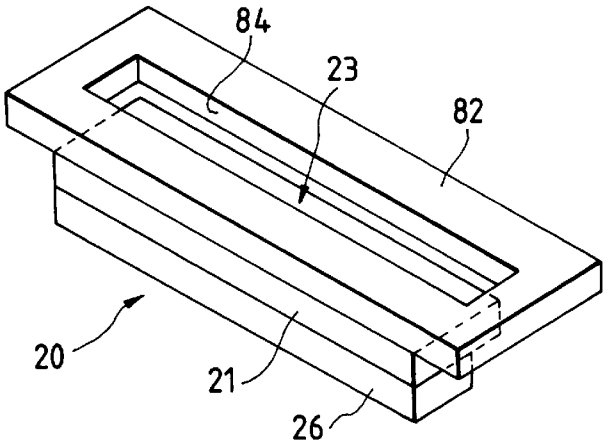
FIG. 31 is a perspective view illustrating a further example of a portion of an energy generating element unit usable with the ink jet head of the present invention.
Figure 30:
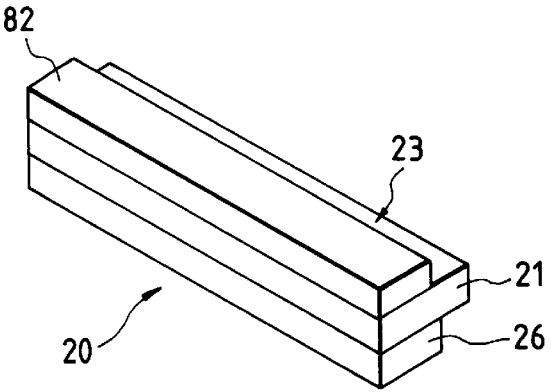
FIG. 30 is a perspective view representing the appearance of a portion of an energy generating element unit for the ink jet head as shown in FIG. 29.

While in the embodiment as shown in FIGS. 21 to 28, the support plate 82 greater than the energy generating element substrate 21 was adopted, and the entire energy generating element substrate 21 was joined with the support plate 82, the use of a smaller support plate 82 than the energy generating element substrate 21 may be possible to form the pressing face 23 on the energy generating element substrate 21, unless there is specifically any problem in respect of the rigidity. The lateral shape of a further embodiment of such an ink jet head of the present invention is shown in FIG. 29, and an appearance of a portion of the energy generating element unit is shown in FIG. 30, wherein like numerals are attached to the same functional members or parts as in the previous embodiment, and no duplicate explanation is given.

That is, at the front end of the energy generating element substrate 21, the support plate 82 having a narrower width than the energy generating element substrate 21 is joined integrally, a portion of the energy generating element substrate 21 located closer to the base end than this support plate 82 serving as the pressing face 23.

In this way, since a portion of the pressing face 23 is directly formed on the surface of the energy generating element substrate 21, despite of the presence of the support plate 82, the pressing face 23 can be brought into closer proximity to the registration face 22, so that the aspect ratio for connection can be made greater than conventionally. Also, since the energy generating element substrate 21 is directly pressed, the entire registration face 22 of the energy generating element substrate 21 can be more securely brought into close union with the registration face 19 of the driving element substrate 18, even if there is more or less nonconforming shape such as warp in the energy generating element substrate 21. As a result, a stabler electrical connection between the registration face 22 of the energy generating element substrate 21 and the registration face 19 of the driving element substrate 18 can be made.

The support plate 82 of the energy generating element unit 20 may be formed in a frame, and the cushion member 24 may be received within this support plate 82. As shown in FIG. 20 representing an appearance of another embodiment of such energy generating element substrate 20, an opening 84 facing the pressing face 23 of the energy generating element substrate 21 is formed in the center of the support plate 82, such that the cushion member 24 can be received within this opening 84 and pressed against the pressing face 23 of the energy generating element substrate 21.

In the embodiment as shown in FIG. 29 and FIG. 30, a thinner portion 29 can be further formed in the energy generating element substrate 21. The lateral shape of a further embodiment of such an ink jet head of the present invention is shown in FIG. 32, and an appearance of a portion of the energy generating element unit is shown in FIG. 33, wherein like numerals are attached to the same functional members or parts as in the previous embodiment, and no duplicate explanation is given.

That is, at the base end of the energy generating element substrate 21, the thinner portion 29 which is smaller in thickness than other portions is formed, wherein the surface of this thinner portion 29 is used as the pressing face 23.

Hence, despite of the presence of the support plate 82, the pressing face 23 can be brought into closer proximity to the registration face 22, so that the aspect ratio for connection can be made greater than conventionally. Also, the entire registration face 22 of the energy generating element substrate 21 can be more securely brought into close union with the registration face 19 of the driving element substrate 18, even if there is more or less nonconforming shape such as warp in the energy generating element substrate 21, so that a stabler electrical connection between the registration face 22 of the energy generating element substrate 21 and the registration face 19 of the driving element substrate 18 can be made.

Figure 32:
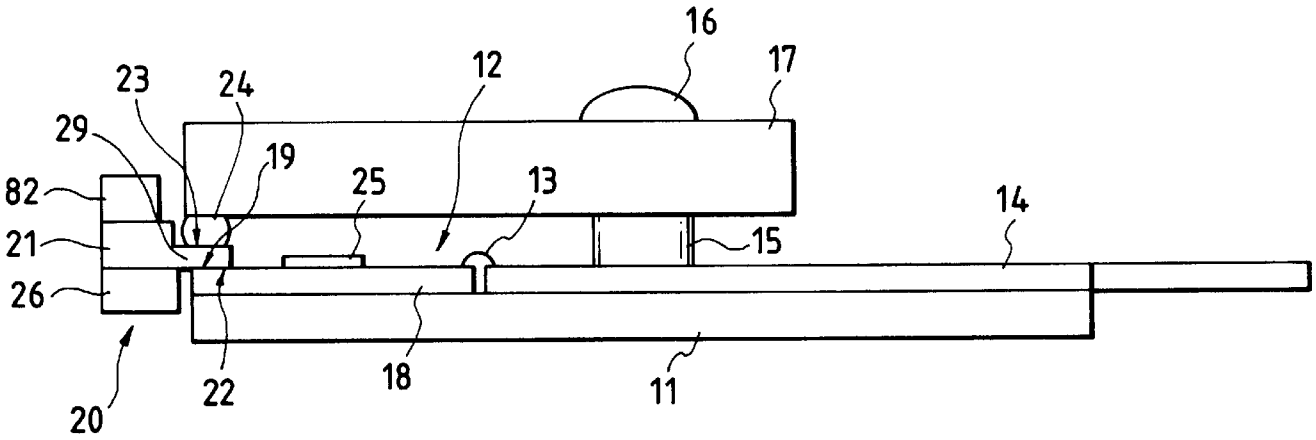
FIG. 32 is a side view representing the appearance of a further embodiment of an ink jet head according to the present invention.
Figure 33:
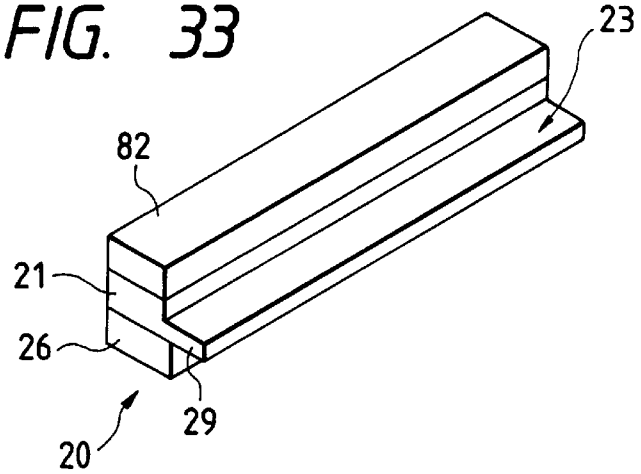
FIG. 33 is a perspective view representing the appearance of a portion of an energy generating element unit for the ink jet head as shown in FIG. 32.
Figure 34:
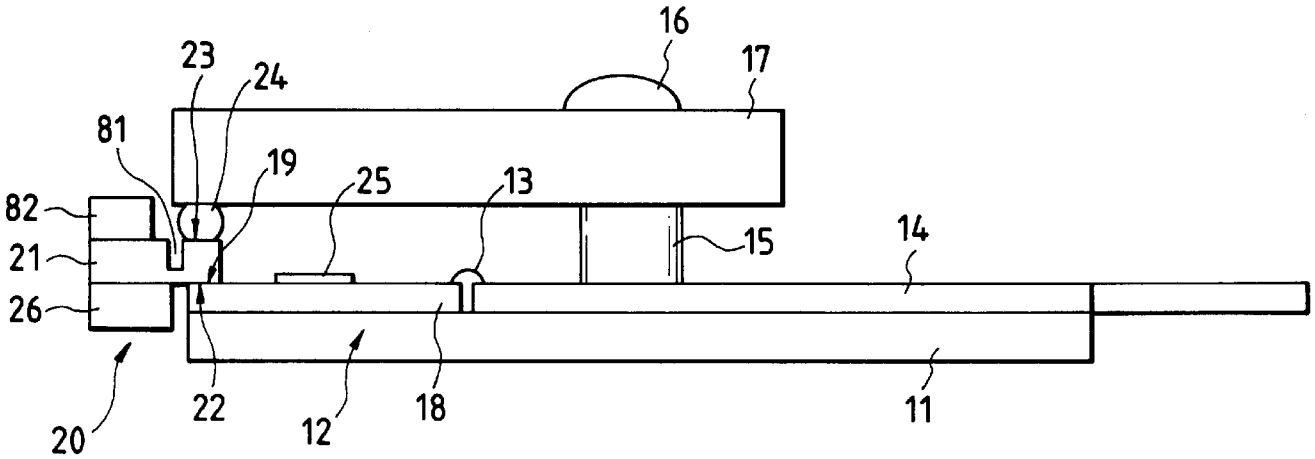
FIG. 34 is a side view representing the appearance of a further embodiment of an ink jet head according to the present invention.
Figure 35:
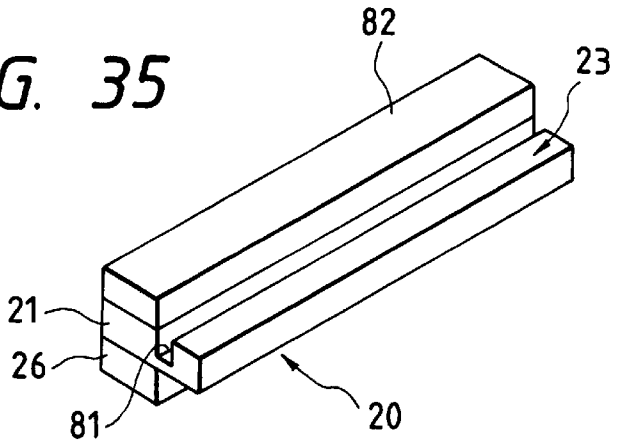
FIG. 35 is a perspective view representing the appearance of a portion of an energy generating element unit for the ink jet head as shown in FIG. 34.

In the embodiment of the present invention as shown in FIGS. 32 to 33, the energy generating element substrate 21 was formed with the thinner portion 29, but the same effect can be also obtained by forming a groove. The lateral shape of another embodiment of such an ink jet head according to the present invention is shown in FIG. 34, and an appearance of a portion of the energy generating element unit is shown in FIG. 35, wherein like numerals are attached to the same functional members or parts as in the previous embodiment, and no duplicate explanation is given.

That is, on the pressing face 23 of the energy generating element substrate 20 is engraved a groove portion 81 extending along this pressing face 23, whereby since a portion of the energy generating element substrate 20 corresponding to this groove portion 81 is smaller in thickness and thus reduced in rigidity, the entire registration face 22 of the energy generating element substrate 21 can be securely brought into close union with the registration face 19 of the driving element substrate 18 by the pressing force of the presser bar 17, even if there is more or less nonconforming shape such as warp in the energy generating element substrate 21. As a result, a stabler electrical connection between the registration face 22 of the energy generating element substrate 21 and the registration face 19 of the driving element substrate 18 can be made.

Figure 36:
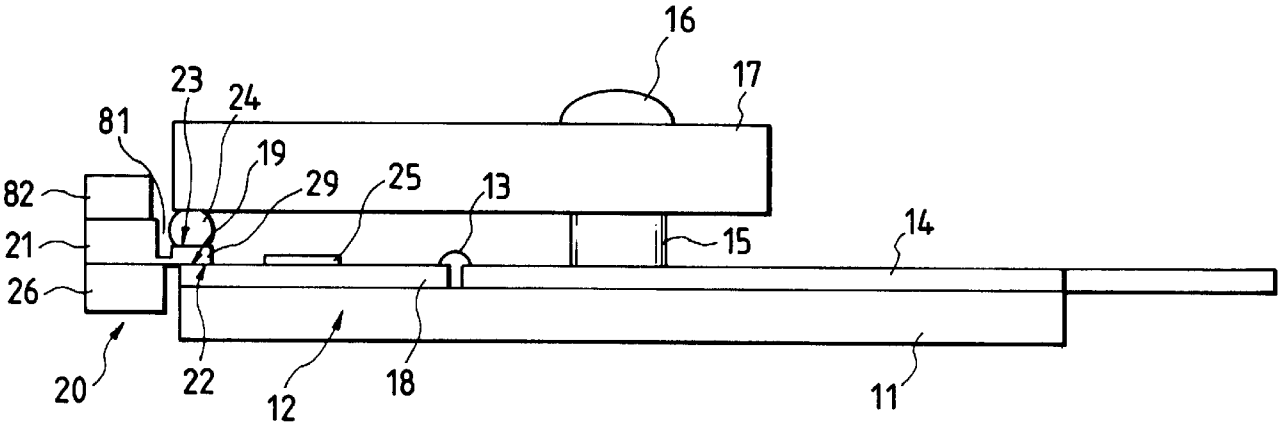
FIG. 36 is a side view representing the appearance of a further embodiment of an ink jet head according to the present invention.
Figure 37:
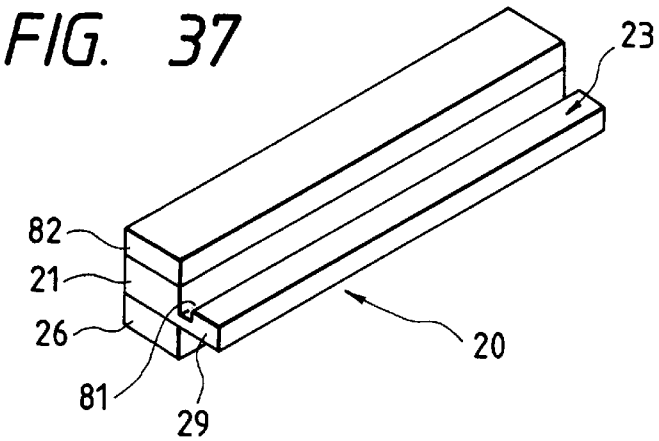
FIG. 37 is a perspective view representing the appearance of a portion of an energy generating element unit for the ink jet head as shown in FIG. 36.

Though the embodiments as shown FIGS. 32 to 33 and FIGS. 34 to 35 can be used in any combination, the lateral shape of another embodiment of such an ink jet head of the present invention is shown in FIG. 36, and an appearance of a portion of the energy generating element unit is shown in FIG. 37, wherein like numerals are attached to the same functional members or parts as in the previous embodiment, and no duplicate explanation is given.

That is, by forming the groove portion 81 on the thinner portion 29 of the energy generating element substrate 21, the entire registration face 22 of the energy generating element substrate 21 can be more securely brought into close union with the registration face 19 of the driving element substrate 18 than in the embodiment as shown in FIGS. 32 to 33, even if there is more or less nonconforming shape such as warp in the energy generating element substrate 21, so that a stabler electrical connection between the registration face 22 of the energy generating element substrate 21 and the registration face 19 of the driving element substrate 18 can be made.

Any of the recording heads of the present invention as above detailed can be incorporated into the head cartridge as shown in FIG. 15, and mounted on the recording apparatus as shown in FIG. 16.

While in the above-described examples, the present invention was described using a printer having an ink jet recording head mounted on the cartridge, it should be understood that the present invention can be suitably used for an information processing apparatus which can read image information from the original sheet carried on the platen, by means of a scanner unit which can be mounted on the carriage, compatibly with the ink jet recording head, by having the almost same outer shape as the ink jet recording head, for example.

In addition, the recording apparatus according to the present invention may be provided in the form of an image output terminal of the information processing equipment such as word processors or computers, integrally or separately, a copying machine in combination with the reader, and further a facsimile apparatus having the transmission and reception feature.

What is claimed is:

1. A recording head comprising:

a recording element substrate on which a plurality of recording elements and first connecting electrodes connecting to said recording elements are disposed;

a driving element substrate on which a plurality of driving elements for driving said plurality of recording elements and second connecting electrodes connecting to said driving elements are disposed; and a pressing member for applying a pressing force to press together said recording element substrate and said driving element substrate, at least a portion of said recording element substrate being sandwiched between said driving element substrate and said pressing member;

wherein said recording element substrate and said driving element substrate are pressed together by said pressing member to connect said first connecting electrodes and said second connecting electrodes, and wherein said recording element substrate is supported only by the pressing force applied by the pressing member.

2. A recording head according to claim 1, further comprising a circuit substrate, connected to said driving element substrate, for entering a signal from an outside into said driving elements.

3. A recording head according to claim 2, further comprising a base board for securing said driving element substrate and said circuit substrate together.

4. A recording head according to claim 1, wherein said pressing has a pressure bonding plate for producing said pressing force, and an elastic member interposed between said pressure bonding plate and said recording element substrate.

5. A recording head according to claim 4, wherein said pressure bonding plate is made of an electrically conductive material.

6. A recording head according to claim 1, further comprising an interposing member provided on said recording element substrate so that the position on said recording element substrate at which said first connecting electrodes are disposed and a center of gravity of said recording element substrate may be almost coincident.

7. A recording head according to claim 6, wherein said interposing member is made of an electrically conductive material.

8. A recording head according to claim 1, wherein said pressing member has a plurality of projections for distributing said pressing force over a plurality of sites.

9. A recording head according to claim 1, wherein said pressing member has a convex and concave shape for distributing said pressing force over a plurality of sites.

10. A recording head according to claim 1, wherein said recording element substrate has a thinner portion and said pressing member presses said recording element substrate at said thinner portion.

11. A recording head according to claim 10, wherein said thinner portion has a groove.

12. A recording head according to claim 1, further comprising a support plate joined to said recording element substrate for reinforcement of said recording element substrate, said support plate having a thinner portion, said support plate being joined to said recording element substrate, and said thinner portion being provided on the side of said support plate which faces said pressing member.

13. A recording head according to claim 12, wherein said thinner portion has a groove.

14. A recording head according to claim 1, wherein a plurality of liquid channels in communication with a plurality of discharge ports for discharging the liquid are provided corresponding to said recording elements on said recording substrate.

15. A recording head according to claim 14, wherein said plurality of discharge ports are provided over an entire width of recording.

16. A recording head according to claim 14, wherein said recording elements are heat energy generators for generating heat energy for use in recording.

17. A recording head according to claim 1, wherein said recording elements are heat energy generators for generating heat energy for use in recording.

18. A head cartridge comprising:

a recording element substrate on which a plurality of recording elements and first connecting electrodes connecting to said recording elements are disposed;

a driving element substrate on which a plurality of driving elements for driving said plurality of recording elements and second connecting electrodes connecting to said driving elements are disposed; and a pressing member for applying a pressing force to press together said recording element substrate and said driving element substrate, at least a portion of said recording element substrate being sandwiched between said driving element substrate and said pressing member;

wherein said recording element substrate and said driving element substrate are pressed together by said pressing member to connect said first connecting electrodes and said second connecting electrodes, said head cartridge further having a recording head for discharging a liquid using energy generated by said recording elements, and a reservoir for reserving the liquid to be supplied to said recording head, and wherein said recording element substrate is supported only by the pressing force applied by the pressing member.

19. A recording apparatus having a mount portion for mounting a recording head comprising:

a recording element substrate on which a plurality of recording elements and first connecting electrodes connecting to said recording elements are disposed;

a driving element substrate on which a plurality of driving elements for driving said plurality of recording elements and second connecting electrodes connecting to said driving elements are disposed; and a pressing member for applying a pressing force to press together said recording element substrate and said driving element substrate, at least a portion of said recording element substrate being sandwiched between said driving element substrate and said pressing member;

wherein said recording element substrate and said driving element substrate are pressed together by said pressing member to connect said first connecting electrodes and said second connecting electrodes, and wherein said recording element substrate is supported only by the pressing force applied by the pressing member.

* * * * *

UNITED STATES PATENT AND TRADEMARK OFFICE

CERTIFICATE OF CORRECTION

PATENT NO. : 6,084,611
DATED : July 4,, 2000
INVENTOR(S) : Toru Yamane et al.

It is certified that error appears in the above-identified patent and that said Letters Patent is hereby corrected as shown below:

TITLE PAGE:

Column [54] TITLE:
"HEAD," should read --HEAD-- and "BINDING" should read --BONDING--.

Column [56] References Cited, under Foreign Patent Documents:
"1-302829 6/1989 Japan." should read --1-302829 12/1989 Japan--.

Column [57] ABSTRACT:
Line 4, "disposed a" should read --disposed, a--.

Column1
Line 1, "HEAD," should read --HEAD--; and
Line 2, "BINDING" should read --BONDING--.

Column 9
Line 18, "for" should read --form--.

Column 10
Line 36, "of e.g." should read --of, e.g.,--;
Line 37, "parallelopiped" should read --parallelepiped--;
Line 44, "welding" should read --bonding--; and

UNITED STATES PATENT AND TRADEMARK OFFICE

CERTIFICATE OF CORRECTION

PATENT NO. : 6,084,611
DATED : July 4, 2000
INVENTOR(S) : Toru Yamane et al.

It is certified that error appears in the above-identified patent and that said Letters Patent is hereby corrected as shown below:

Column 10 contd.
Line 47, "welding" should read --bonding--.

Column 12
Line 66, "predetermined" should read --a predetermined--.

Column 13
Line 17, "This" should read --That--.

Column 17
Line 64, "pressing" should read --pressing member--.

Signed and Sealed this

Second Day of October, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,084,611
DATED : July 4, 2000
INVENTOR(S) : Toru Yamane et al.

It is certified that error appears in the above-identified patent and that said Letters Patent is hereby corrected as shown below:

Title page,
Item [54], "HEAD," should read -- HEAD --; and "BINDING" should read -- BONDING --.
Item [56], FOREIGN PATENT DOCUMENTS, "1-302829 6/1989 Japan." should read -- 1-302829 12/1989 Japan. --.
Item [57], ABSTRACT,
Line 4, "disposed a" should read -- disposed, a --.

Column 1,
Line 1, "HEAD," should read -- HEAD --;
Line 2, "BINDING" should read -- BONDING --.

Column 9,
Line 18, "for" should read -- form --.

Column 10,
Line 36, "of e.g." should read -- of, e.g., --;
Line 37, "parallelopiped" should read -- parallelepiped --;
Lines 44 and 47, "welding" should read -- bonding --.

Column 12,
Line 66, "predetermined" should read -- a predetermined --.

Column 13,
Line 18, "This" should read -- That --;

UNITED STATES PATENT AND TRADEMARK OFFICE

CERTIFICATE OF CORRECTION

PATENT NO. : 6,084,611
DATED : July 4, 2000
INVENTOR(S) : Toru Yamane et al.

It is certified that error appears in the above-identified patent and that said Letters Patent is hereby corrected as shown below:

Column 17,
Line 64, "pressing" should read -- pressing member --.

Signed and Sealed this

Ninth Day of July, 2002

*Attest:*

*Attesting Officer*

JAMES E. ROGAN
*Director of the United States Patent and Trademark Office*